US006120429A

United States Patent [19]

Walters

[11] Patent Number: 6,120,429

[45] Date of Patent: Sep. 19, 2000

[54] METHOD OF USING INERTIAL TUBE INDEXER

[75] Inventor: Michael R. Walters, Baltimore, Md.

[73] Assignee: Becton, Dickinson and Company, Franklin Lakes, N.J.

[ * ] Notice: This patent is subject to a terminal disclaimer.

[21] Appl. No.: 09/033,367

[22] Filed: Mar. 2, 1998

[51] Int. Cl.[7] ..... B04B 7/00

[52] U.S. Cl. ..... 494/37

[58] Field of Search ..... 494/1, 11, 16, 494/19, 20, 31, 33, 37, 47; 366/217; 422/72

[56] References Cited

U.S. PATENT DOCUMENTS

| | | | |
|---|---|---|---|
| 1,011,929 | 12/1911 | Ecaubert | 494/33 |
| 1,044,570 | 11/1912 | Raasloff et al. | 494/33 |
| 3,199,775 | 8/1965 | Drucker | 494/19 |
| 3,235,173 | 2/1966 | Unger | 494/19 |
| 3,741,011 | 6/1973 | Seybold . | |
| 3,768,727 | 10/1973 | Proni | 494/19 |
| 3,848,796 | 11/1974 | Bull | 494/19 |
| 3,882,716 | 5/1975 | Beiman | 494/19 |
| 3,955,890 | 5/1976 | Bessis et al. . | |
| 4,027,660 | 6/1977 | Wardlaw et al. . | |
| 4,077,396 | 3/1978 | Wardlaw et al. . | |
| 4,082,085 | 4/1978 | Wardlaw et al. . | |
| 4,131,369 | 12/1978 | Gordon et al. | 494/19 |
| 4,156,570 | 5/1979 | Wardlaw . | |
| 4,428,669 | 1/1984 | Bessis . | |
| 4,479,720 | 10/1984 | Mochida et al. | 494/19 |
| 4,555,183 | 11/1985 | Thomas . | |
| 4,558,947 | 12/1985 | Wardlaw . | |
| 4,567,754 | 2/1986 | Wardlaw et al. . | |
| 4,774,965 | 10/1988 | Rodriguez et al. . | |
| 4,776,832 | 10/1988 | Martin et al. | 494/19 |
| 4,812,294 | 3/1989 | Combs | 422/72 |
| 4,823,624 | 4/1989 | Rodriguez et al. . | |
| 4,848,917 | 7/1989 | Benin et al. . | |
| 5,045,047 | 9/1991 | Hutchins et al. | 494/19 |
| 5,104,807 | 4/1992 | Mitsumaki et al. | 494/19 |
| 5,195,825 | 3/1993 | Ringrose . | |
| 5,380,087 | 1/1995 | Haber et al. . | |
| 5,888,184 | 3/1999 | Wardlaw . | |
| 5,889,584 | 3/1999 | Wardlaw . | |

FOREIGN PATENT DOCUMENTS

| | | | |
|---|---|---|---|
| 1002029 | 3/1983 | U.S.S.R. | 494/19 |

OTHER PUBLICATIONS

Stephen C. Wardlaw, MD, et al., "Quantitative Buffy Coat Analysis —A New Laboratory Tool Functioning as a Screening Complete Blood Cell Count", *Journal of the American Medical Association*, vol. 249, Feb. 4, 1983, pp. 617–620.

Robert L. Sallitt, etal., "Evaluation of Leukocyte Differential Counts on the QBC® Centrifugal Hemotology Analyzer According to NCCLS Standard H2O–T", *Blood Cells*, vol. 11, 1986, pp. 281–294.

QBC® Centrifugal Hematology Control Kit Brochure, Becton Dickinson and Company, 1988.

QBC® Autoread™ Centrifugal Hematology System Brochure, Becton Dickinson and Company, 1991.

QBC® Centrifuge System Centrifuge Model 424740 Brochure, Becton Dickinson and Company, Aug., 1993.

QBC® Centrifugal Hematology Control Brochure, Becton Dickinson and Company, 1995.

QBC® Hematology Control Assay, Becton Dickinson and Company, 1996.

QBC® Autoread ™ Plus Brochure, Becton Dickinson and Company, 1996.

QBC® Hematology Control Instructions for Use, Becton Dickinson and Company published prior to 1998.

*Primary Examiner*—Charles E. Cooley

*Attorney, Agent, or Firm*—Bruce S. Weintraub, Esq.

[57] ABSTRACT

A method for rotating a fluid tube about its longitudinal axis while a centrifuge apparatus is rotating the fluid tube in a rotational direction transverse to the longitudinal axis of the tube by utilizing an apparatus comprising an engaging member configured to engage a gear which is mechanically coupled to the fluid tube, and a driver configured to apply a driving force to the engaging member to cause the engaging member to engage and rotate the gear, which rotates the fluid tube about its longitudinal axis. This method can therefore obtain readings of the centrifuged sample from different locations about the circumference of the fluid tube at different orientations of the fluid tube.

8 Claims, 22 Drawing Sheets

METHOD OF USING INERTIAL TUBE INDEXER

CROSS-REFERENCE TO RELATED APPLICATIONS

Related subject matter is disclosed and claimed in a U.S. patent application of Stephen C. Wardlaw entitled "Assembly for Rapid Measurement of Cell Layers", Ser. No. 08/814,536, filed on Mar. 10, 1997 which has issued as U.S. Pat. No. 5,889,584; in a U.S. patent application of Stephen C. Wardlaw entitled "Method for Rapid Measurement of Cell Layers", Ser. No. 08/814,535, filed on Mar. 10, 1997 which has issued as U.S. Pat. No. 5,888,184; in a U.S. patent application of Michael R. Walters entitled "Centrifugally Actuated Tube Rotator Mechanism" (Ser. No. 08/918,437), now abandoned; in U.S. patent applications of Michael A. Kelly, Edward G. King, Bradley S. Thomas and Michael R. Walters entitled "Disposable Blood Tube Holder" and "Method for Using Disposable Blood Tube Holder", Ser. Nos. 09/033,373 and 09/033,119 filed on even date herewith; in U.S. patent applications of Bradley S. Thomas, Michael A. Kelly, Michael R. Walters, Edward M. Skevington and Paul F. Gaidis entitled "Blood Centrifugation Device with Movable Optical Reader" and "Method For Using Blood Centrifugation Device With Movable Reader", Ser. Nos. 09/033,368 and 09/032,934, now U.S. Pat. No. 6,002,474 filed on even date herewith; and in a corresponding U.S. patent application of Bradley S. Thomas, entitled "Flash Tube Reflector With Arc Guide", Ser. No. 09/032,935, now U.S. Pat. No. 6,030,086, filed on even date herewith, all of said applications being expressly incorporated herein by reference.

BACKGROUND OF THE INVENTION

The present invention relates generally to an indexing device, for use in a centrifuge device, which rotates a blood tube about its longitudinal axis while the blood tube is being rotated by the centrifuge device. More particularly, the present invention relates to an indexing device which is coupled to the rotor of a centrifuge device, and which is controlled by relative movement of the rotor to rotate a blood tube in the rotor about an axis substantially corresponding to the longitudinal axis of the blood tube, while the rotor is spinning the blood tube, so that images of the centrifuged blood can be obtained from different locations about the circumference of the blood tube.

As part of a routine physical or diagnostic examination of a patient, it is common for a physician to order a complete blood count for the patient. The patient's blood sample may be collected in one of two ways. In the venous method, a syringe is used to collect a sample of the patient's blood in a test tube containing an anticoagulation agent. A portion of the sample is later transferred to a narrow glass capillary tube, known as a sample tube. The open end of the sample tube is placed in the blood sample in the test tube, and a quantity of blood enters the sample tube by capillary action. In the capillary method, the syringe and test tube are not used and the patient's blood is introduced directly into sample tube from a small incision made in the skin. In either case, the sample tube is then placed in a centrifuge, such as the Model 424740 centrifuge manufactured by Becton Dickinson and Company.

In the centrifuge, the sample tube containing the blood sample is rotated at a desired speed (typically 8,000 to 12,000 rpm) for several minutes. The high speed centrifugation separates the components of the blood by density.

Specifically, the blood sample is divided into a layer of red blood cells, a buffy coat region consisting of layers of granulocytes, mixed lymphocytes and monocytes, and platelets, and a plasma layer. The length of each layer can then be optically measured, either manually or automatically, to obtain a count for each blood component in the blood sample. This is possible because the inner diameter of the sample tube and the packing density of each blood component are known, and hence the volume occupied by each layer and the number of cells contained within it can be calculated based on the measured length of the layer. Exemplary measuring devices that can be used for this purpose include those described in U.S. Pat. Nos. 4,156,570 and 4,558,947, both to Stephen C. Wardlaw, and the QBC® "AUTOREAD" hematology system manufactured by Becton Dickinson and Company.

Several techniques have been developed for increasing the accuracy with which the various layer thickness in the centrifuged blood sample can be determined. For example, because the buffy coat region is typically small in comparison to the red blood cell and plasma regions, it is desirable to expand the length of the buffy coat region so that more accurate measurements of the layers in that region can be made. As described in U.S. Pat. Nos. 4,027,660, 4,077,396, 4,082,085 and 4,567,754, all to Stephen C. Wardlaw et al., and in U.S. Pat. No. 4,823,624, to Rodolfo R. Rodriguez et al., this can be achieved by inserting a precision-molded plastic float into the blood sample in the sample tube prior to centrifugation. The float has approximately the same density as the cells in the buffy coat region, and thus becomes suspended in that region after centrifugation. Since the outer diameter of the float is only slightly less than the inner diameter of the sample tube (typically by about 80 $\mu$m), the length of the buffy coat region will expand to make up for the significant reduction in the effective diameter of the tube that the buffy coat region can occupy due to the presence of the float. By this method, an expansion of the length of the buffy coat region by a factor between 4 and 20 can be obtained. The cell counts calculated for the components of the buffy coat region will take into account the expansion factor attributable to the float.

Another technique that is used to enhance the accuracy of the layer thickness measurements is the introduction of fluorescent dyes (in the form of dried coatings) into the sample tube. When the blood sample is added to the sample tube, these dyes dissolve into the sample and cause the various blood cell layers to fluoresce at different optical wavelengths when they are excited by a suitable light source. As a result, the boundaries between the layers can be discerned more easily when the layer thickness are measured following centrifugation.

Typically, the centrifugation step and the layer thickness measurement step are carried out at different times and in different devices. That is, the centrifugation operation is first carried out to completion in a centrifuge, and the sample tube is then removed from the centrifuge and placed in a separate reading device so that the blood cell layer thicknesses can be measured. This added step of removing the blood tube from the centrifuge device increases the time needed to complete the layer reading process. Furthermore, because the tubes must be handled and moved between the centrifuging device and layer reading device, the likelihood that damage to the tubes can occur is increased. Additionally, because the centrifuging is stopped when the blood tube is being moved from the centrifuge device to the layer reading device, the blood components that have been compacted into their individual layers due to the centrifugation may begin to migrate into adjacent layers, thus resulting in inaccurate readings. Also, since the centrifuge can "spin down" multiple sample tubes, the manual transfer to the reading devices increases the chance of sample ID error.

More recently, a technique has been developed in which the layer thicknesses are calculated using a dynamic or predictive method while centrifugation is taking place. This is advantageous not only in reducing the total amount of time required for a complete blood count to be obtained, but also in allowing the entire procedure to be carried out in a single device. Apparatus and methods for implementing this technique are disclosed in the aforementioned copending applications of Stephen C. Wardlaw entitled "Assembly for Rapid Measurement of Cell Layers", Ser. No. 08/814,536, now U.S. Pat. No. 5,889,584 and "Method for Rapid Measurement of Cell Layers", Ser. No. 08/814,535, now U.S. Pat. No. 5,888,184.

In order to allow the centrifugation and layer thickness measurement steps to be carried out simultaneously, it is necessary to "freeze" the image of the sample tube as it rotates at high speed on the centrifuge rotor. This can be accomplished by means of a xenon flash lamp assembly that produces an intense excitation pulse of light energy once per revolution of the centrifuge rotor. The pulse of light excites the dyes in the expanded buffy coat area of the sample tube, causing the dyes to fluoresce with light of known wavelengths. The emitted fluorescent light resulting from the excitation flash is focused, by a high-resolution lens onto a linear array of charge-coupled devices (CCDs). The CCD array is located behind a bandpass filter which selects the specific wavelength of emitted light to be imaged onto the CCD array.

The xenon flash lamp assembly is one of two sources that are used to illuminate the sample tube while the centrifuge rotor is in motion. The other source is an array of light-emitting diodes (LEDs) which transmit red light through the sample tube for detection by the CCD array through a second bandpass filter. The purpose of the transmitted light is to locate the beginning and end of the plastic float (and hence the location of the expanded buffy coat area), and the fill lines. Further details of the optical reading apparatus may be found in the aforementioned copending application of Bradley S. Thomas et al. entitled "Blood Centrifuge Device with Movable Optical Reader", Ser. No. 09/033,368.

In order to obtain an accurate measurement of the lengths of the blood component layers, it is necessary to take a sample of readings about the circumference of the tube. That is, when the blood is centrifuged so that layers of the blood components are formed in the tube, it is likely that the lengths of the layers will not be uniform across the entire inner diameter of the tube. Rather, it is common for a layer to have a longer length on one side of the tube and a shorter length on the other side. Because the cell count calculations are based on the measured length of the layers, if the measurements are taken from only one side of the tube, it is likely that inaccurate cell counts will be calculated.

Accordingly, it is desirable to rotate the tube of centrifuged blood so that readings can be taken at various locations (e.g., 8 different locations) about the circumference of the tube. The respective readings for each layer are then averaged, so that an average length is computed for each layer. The average length for each layer is used to calculate the cell count for each respective blood component in the centrifuged blood sample, thus providing more accurate cell counts.

One method for rotating the tube of centrifuged blood about its longitudinal axis while the sample tube remains in the centrifuge device and is being spun by the rotor of the centrifuge device is disclosed in a copending U.S. patent application of Michael R. Walters entitled "Centrifugally Actuated Tube Rotator Mechanism" (Ser. No. 08/918,437), now abandoned. This apparatus includes a cylindrical cup that receives one and end of the sample tube, and a cam mechanism that operates to operate the cup about its longitudinal axis. The cam mechanism is driven by changing the speed of the rotor. That is, as the speed of the rotor is changed, the cam mechanism is driven radially of the rotor, and translates this radial movement into rotational movement which rotates the cup and the tube received therein.

Although the apparatus described in the copending U.S. patent application of Michael R. Walters et al. entitled "Centrifugally Actuated Tube Rotator Mechanism" (Ser. No. 08/918,437), now abandoned is effective for its intended purpose, a continuing need exists for an apparatus which is capable of centrifuging a blood sample stored in a capillary tube and taking accurate measurements of the component layers of the centrifuged blood sample while allowing the capillary tube to remain in the centrifuge device. The present invention is directed to that objective.

SUMMARY OF THE INVENTION

An object of the present invention is to provide an indexing apparatus which is used in a centrifuge device to rotate a capillary tube, in which a blood sample being centrifuged is contained, incrementally about an axis substantially aligned with the longitudinal axis of the capillary tube, to enable the lengths of layers of the components in the centrifuged blood sample to be accurately measured without removing the capillary tube from the centrifuge apparatus.

Another object of the invention is to provide an indexing apparatus as described above whose rotating of the capillary tube is controlled by movement of the rotor of the centrifuge device relative to the indexing apparatus, thus providing an indexing apparatus which is simple in operation.

A still further object of the invention is to provide an indexing apparatus as described above comprising an engaging member that is configured to engage a gear which is part of a carrier tube in which the sample tube is stored during centrifugation, or which is otherwise mechanically coupled to the sample tube, to rotate the carrier tube and sample tube about an axis substantially aligned with the longitudinal axis of the sample tube.

These and other objects of the invention are substantially achieved by providing an indexing apparatus, adaptable for use in a centrifuge device, and which rotates a blood tube, such as a capillary tube, about a rotational axis which is in substantial alignment with the longitudinal axis of the tube while the centrifuge device is rotating the capillary tube in a centrifuging direction. The indexing apparatus comprises an engaging member, configured to engage a gear which is mechanically coupled to the blood tube, and a driver which applies a driving force to the engaging member to control the engaging member to engage and rotate the gear, which thus rotates the blood tube about the rotational axis, when the centrifuge apparatus is rotating the blood tube in a centrifuging direction. The gear can constitute part of a tube assembly comprising the blood tube, or can instead constitute part of the indexing apparatus and be mechanically coupled to the blood tube. The driver can include a hub which is movably coupled to a rotor that rotates the blood tube in the centrifuging direction so that movement of the rotor relative to the hub controls the driver to apply the driving force to the engaging member to control rotation of the blood tube about the rotational axis.

BRIEF DESCRIPTION OF THE DRAWINGS

These and other objects of the invention will be more readily appreciated from the following detailed description when read in conjunction with the accompanying drawings, in which.

DETAILED DESCRIPTION OF THE PREFERRED EMBODIMENTS

Figure 1:
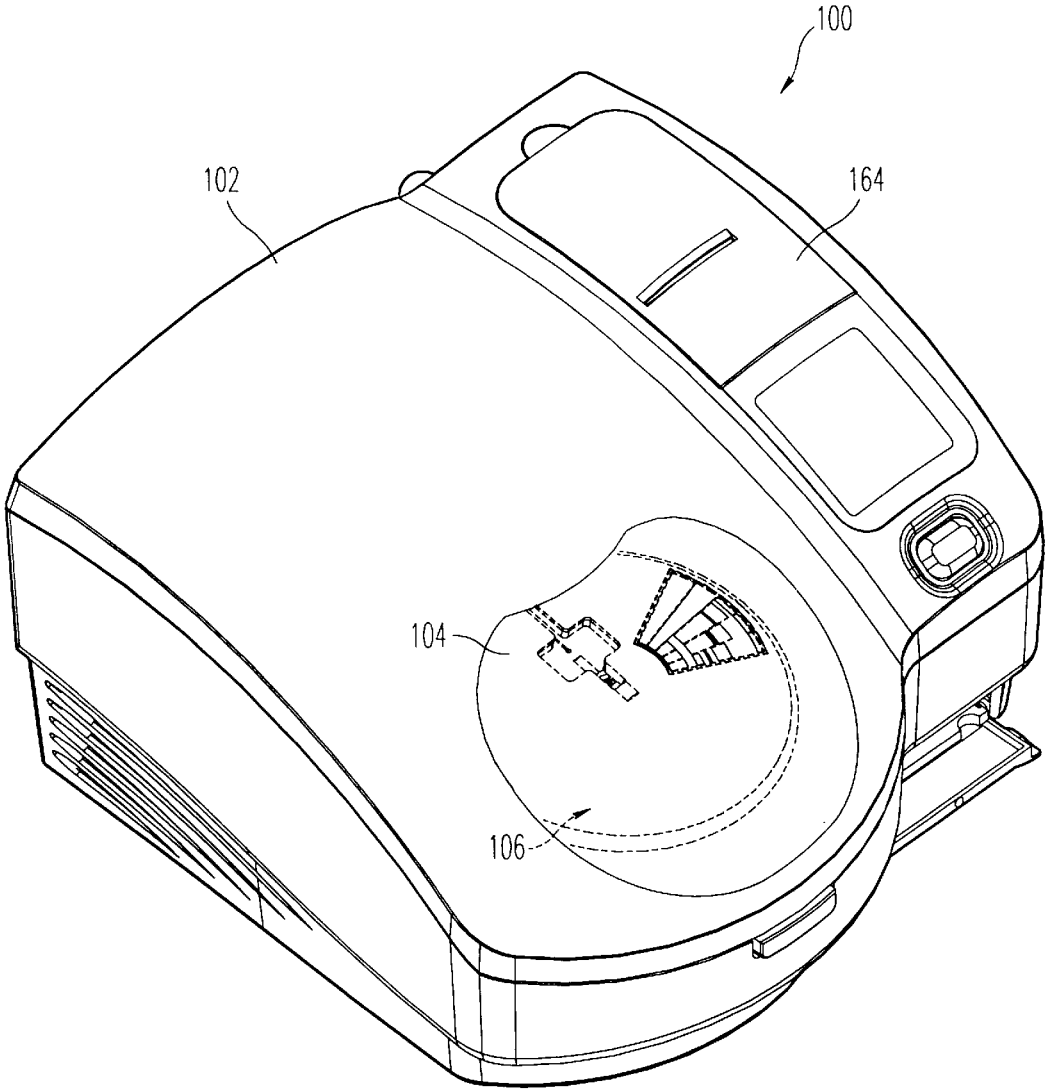
FIG. 1 is a perspective view of a centrifuge device in which the indexing apparatus according to the present invention can be used.
Figure 2:
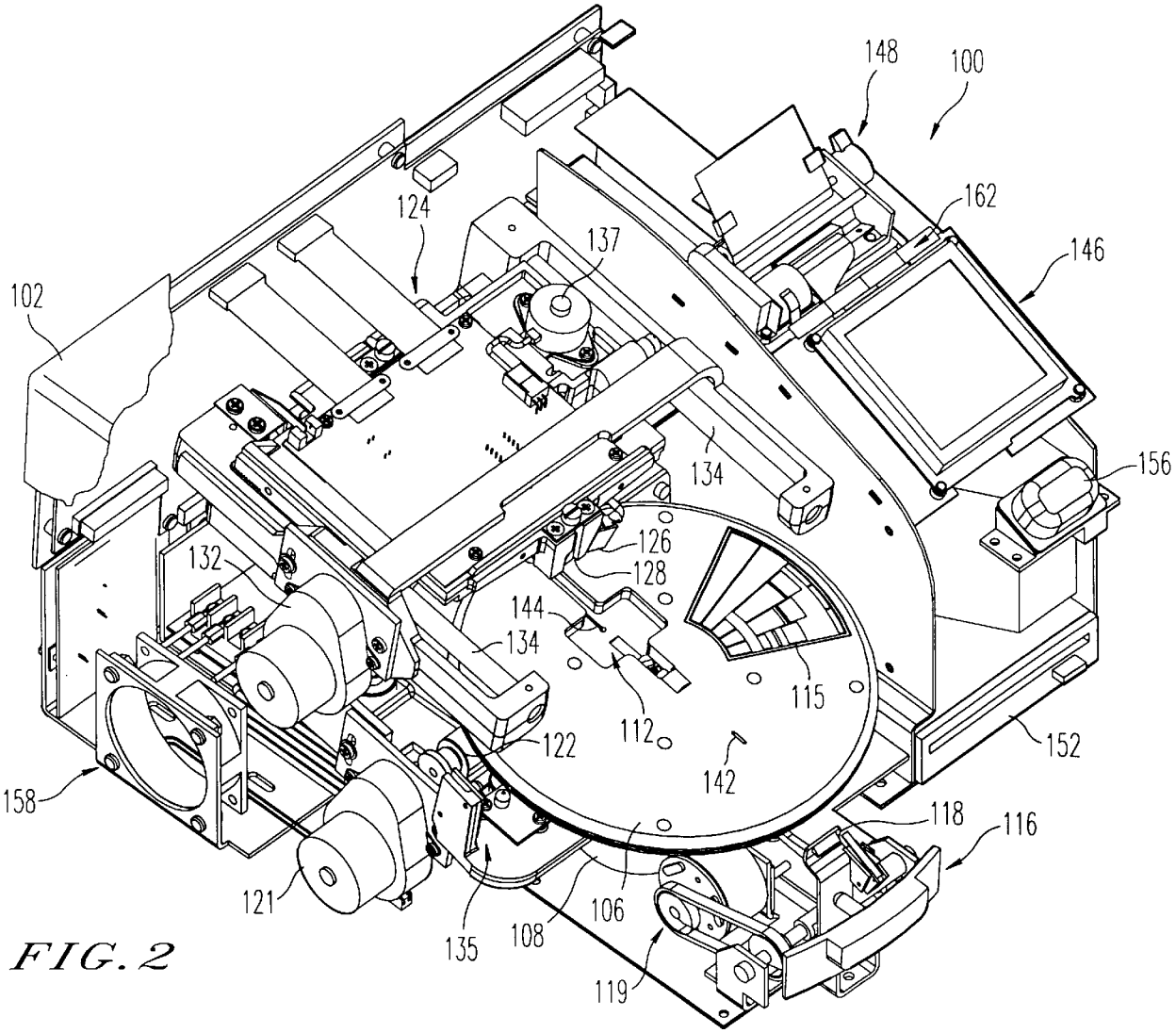
FIG. 2 is a detailed perspective view of the centrifuge device shown in FIG. 1, with the cover being removed to expose the internal components of the device.

A centrifuge device 100 according to an embodiment of the present invention is shown in FIGS. 1 and 2. FIG. 1 illustrates the centrifuge device 100 having a cover 102 and a lid 104 which is positioned in an open position. As illustrated in FIG. 2, the cover 102 of the centrifuge device 100 has been cut away to expose the internal components of the centrifuge device 100.

Figure 3:
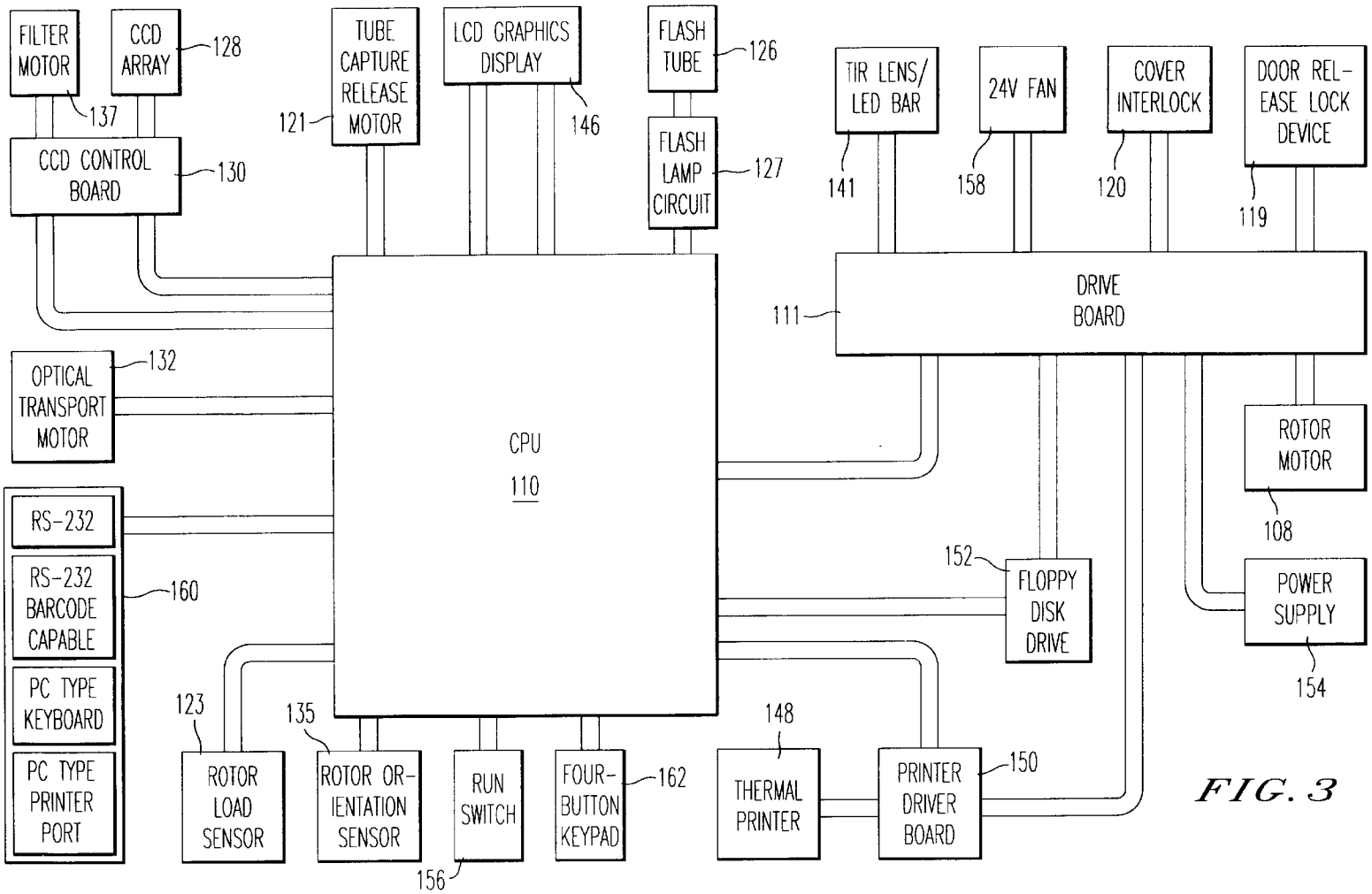
FIG. 3 is a block diagram showing some of the important components of the centrifuge device shown in FIGS. 1 and 2.
Figure 4:
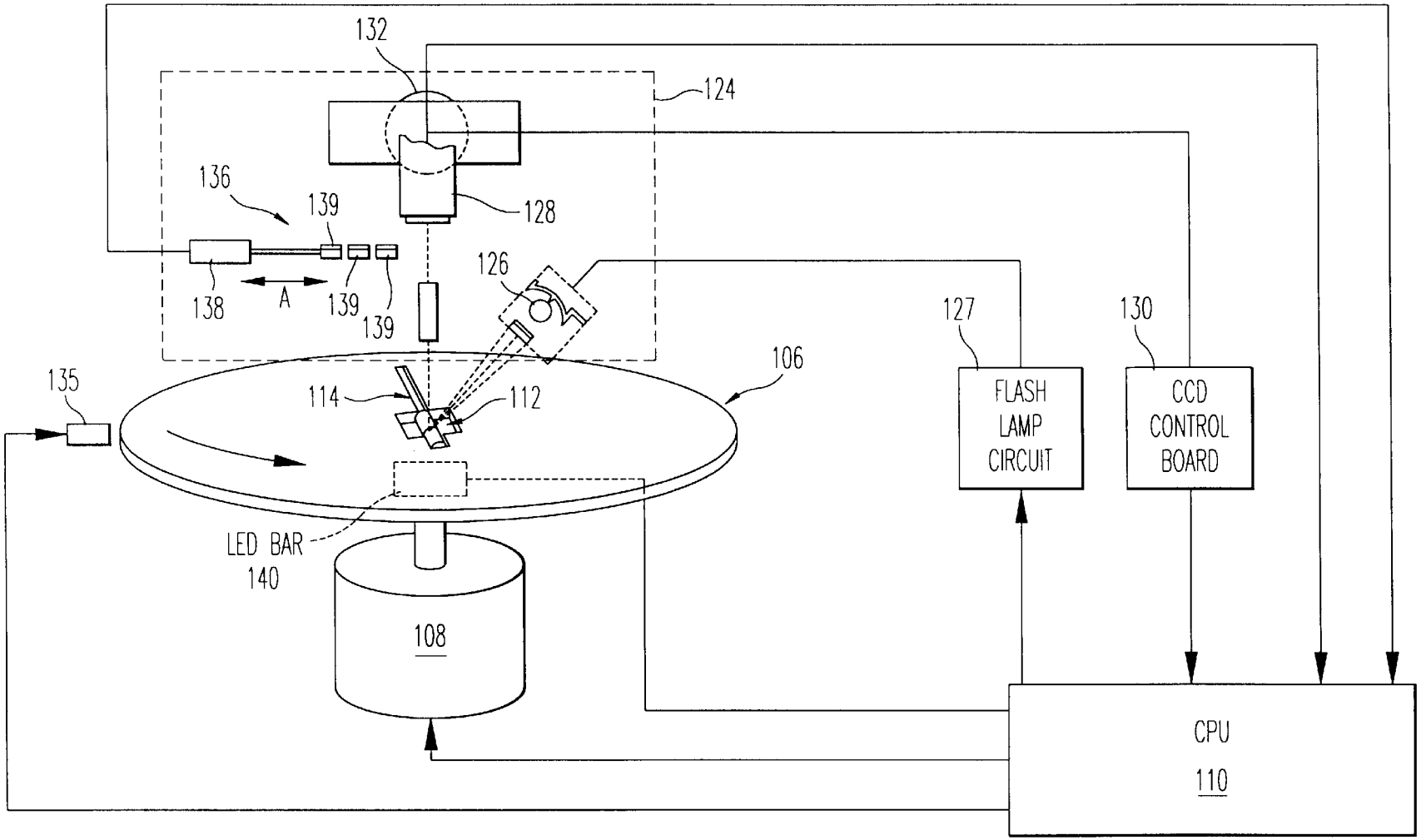
FIG. 4 is a schematic illustrating an example of the relationship between the rotor and optical reading device and some of their associated electrical components of the centrifuge device shown in FIGS. 1 and 2.

As shown in FIG. 2, the block diagram of FIG. 3, and the schematic of FIG. 4, the centrifuge device 100 includes a rotor assembly 106 that is driven by a rotor motor 108 as controlled by a CPU 110 via a driver board 111. As described in more detail below, the rotor assembly 106 includes a carrier tube accommodating recess 112 having an indexing mechanism 113 located therein. A carrier tube 114 as described in the aforementioned copending U.S. patent application of Michael A. Kelly et al. entitled "Disposable Blood Tube Holder", Ser. No. 09/033,373 can be loaded into the carrier tube accommodating recess 112 and engaged by the indexing mechanism 113 as described below. The rotor assembly 106 further includes a calibration label 115 which is used to verify the calibration of the centrifuge device 100 as described in more detail in the aforementioned U.S. patent application of Bradley S. Thomas et al., entitled "Blood Centrifugation Device with Movable Optical Reader", Ser. No. 09/033,368.

The centrifuge device 100 further includes a door release and lock mechanism 116, which includes a door lock 118 that is mechanically operable, and also controllable by a door release/lock drive 119, such as a motor or solenoid which is controlled by CPU 110 via the drive board 111. As discussed in more detail below, the door release and lock mechanism 118 is operated by a user to release the door 104, and thus allow the door 104 to be positioned in the open position as shown in FIG. 1 to provide access to the rotor assembly 106 and, in particular, the carrier tube accommodating recess 112 for insertion and removal of a carrier tube 114. The door release/lock device 119 is also controlled by the CPU 110 to control the door lock 118 to maintain the door 104 in the closed and locked position when the rotor assembly 106 is being driven by the rotor motor 108. A cover interlock sensor 120 senses when the door 104 is locked, and provides a signal to the CPU 110 to this effect via the drive board 111.

As further shown, the centrifuge device 100 includes a tube capture and release motor 121 that is controlled by the CPU 110. As discussed in more detail below and in the aforementioned U.S. patent application of Bradley S. Thomas et al., entitled "Blood Centrifugation Device with Movable Optical Reader", Ser. No. 09/033,368 the CPU 110 controls the tube capture and release motor 122 to drive an engaging mechanism 122 to engage a tube holding assembly of the rotor assembly 106 to allow a carrier tube 114 to be loaded into and removed from the carrier tube accommodating recess 112, and to release the tube holding assembly so that the tube holding assembly secures the carrier tube 114 in the carrier tube accommodating recess 112. A rotor load sensor 123, which can be an optical sensor, detects when the engaging mechanism 122 has returned to its home position after engaging the tube holding assembly and provides a signal to CPU 110. The CPU 110 interprets this signal as an indication that a carrier tube 114 has been loaded into the rotor assembly 106.

As further illustrated, the centrifuge device 100 further includes an optical carriage assembly 124 that includes a flash tube assembly having a flash tube 126 that is energized by a flash lamp circuit 127 as controlled by the CPU 110. The optical carriage assembly further includes a CCD array assembly having a CCD array 128 which is described in more detail below. The CCD array 128 is controlled by a CCD control board 130 that is controlled by CPU 110 to operate in cooperation with flash tube 126, so that when flash tube 126 is driven to emit light towards the carrier tube 114 loaded in the rotor 106, the CCD array 128 is controlled to read light that is illuminated by the contents (e.g., a blood sample) of a capillary tube contained in the carrier tube 114 in response to the light emitted by the flash tube 126. These and other features of the flash tube 126 and CCD array 128, as well as the operation of the carriage assembly 124 as a whole, are described in more detail in the aforementioned copending U.S. patent application of Bradley S. Thomas et al., entitled "Blood Centrifugation Device with Movable Optical Reader", Ser. No. 09/033,368 and in aforementioned copending U.S. patent application of Bradley S. Thomas entitled "Flash Tube Reflector with Arc Guide", Ser. No. 09/032,935, now U.S. Pat. No. 6,030,086.

The optical carriage assembly 124 further includes an optics transport motor 132 which controls the movement of the optical carriage assembly 124 and, in particular, the movement of the CCD array 128, along guide rails 134 in a direction radial of the rotor assembly 106. The optics transport motor 132 is controlled by CPU 110 to move the optical carriage array 124 in this manner so that the CCD array 128 can read the entire sample in the capillary tube contained in the carrier tube 114.

The centrifuge device 100 includes a rotor assembly orientation sensor 135 which, as described in more detail below, senses when the rotor assembly 106 is oriented such that the carrier tube 114 is positioned below the CCD array 128, and provides a signal to CPU 110. When the CPU 110 receives the signal from the rotor assembly orientation sensor 135, the CPU controls the flash tube circuit 127 to drive the flash tube 126, and controls the CCD control board 130 to control the CCD array 128 to read the light emitted from the sample in the capillary tube.

The optical carriage assembly 124 further includes a filter rack 136 which is driven by filter motor 138 to move in a direction indicated by arrow A in FIG. 4, so that each of the individual filters of the filter rack 136 can be positioned in front of the CCD array 128 as desired as described in more detail in the aforementioned copending U.S. patent application of Bradley S. Thomas et al., entitled "Blood Centrifugation Device with Movable Optical Reader", Ser. No. 09/033,368. Each filter 139 in the filter rack 136 is capable of filtering out light having particular wavelengths from the light being emitted by the sample in carrier tube 114, while allowing light of a desired wavelength to pass to the CCD array 128.

Additionally, the centrifuge device 100 includes an LED bar 140 which is disposed below the motor assembly 106 and is controlled by CPU 110 via the drive board 111 to emit light in the direction of rotor assembly 106. This light can pass through slits 142 and 144 in the rotor assembly 106, and be detected by CCD array 128 as the rotor assembly 106 rotates, to ascertain the presence and absence of a carrier tube 114 and the correct positioning of the carrier tube 114 in the carrier tube accommodating recess 112 as described in more detail below.

The centrifuge device 100 also includes an LCD graphics display 146 that is controlled by the CPU 110 to display, for example, information pertaining to the operation of the centrifuge device 100, and information pertaining to the readings of the sample in the capillary tube contained in the carrier tube 114 as taken by the centrifuge device 100. The centrifuge device 100 further includes a thermal printer 148 that is controlled by the CPU 110 via a printer driver board 150 to print out information pertaining to, for example, readings of the centrifuged sample in the capillary tube as taken by the centrifuge device 100.

The centrifuge device 100 also includes a floppy disk drive 152 which can receive a standard floppy disk to which data, such as readings of the centrifuged sample, can be written by the CPU 110, or from which data, such as software upgrades by floppy disk, control information or the like, can be read by the CPU 110. Additionally, the centrifuge device includes a power supply 154 which can be connected to an AC power source to provide power to the centrifuge device 100, a run switch 156 which controls the centrifuge device 100 to begin centrifuging the sample, a fan 158 which can be controlled by the CPU 110 via the drive board 111 to cool the internal components of the centrifuge device 100, and a plurality of interface ports 160 which are capable of coupling to the CPU 110 various types of interface devices, such as a bar code reader, a PC type keyboard, a PC type printer, a RS-232 module, and so on. The centrifuge device 100 also includes a four button key pad 162 which enables an operator to enter information to control the operation of the centrifuge device 100. The key pad 162 can be located, for example, underneath a lid 164 which also provides access to the thermal printer 148, so that printing paper can be replaced, ink cartridges can be replaced, and so on.

Figure 5:
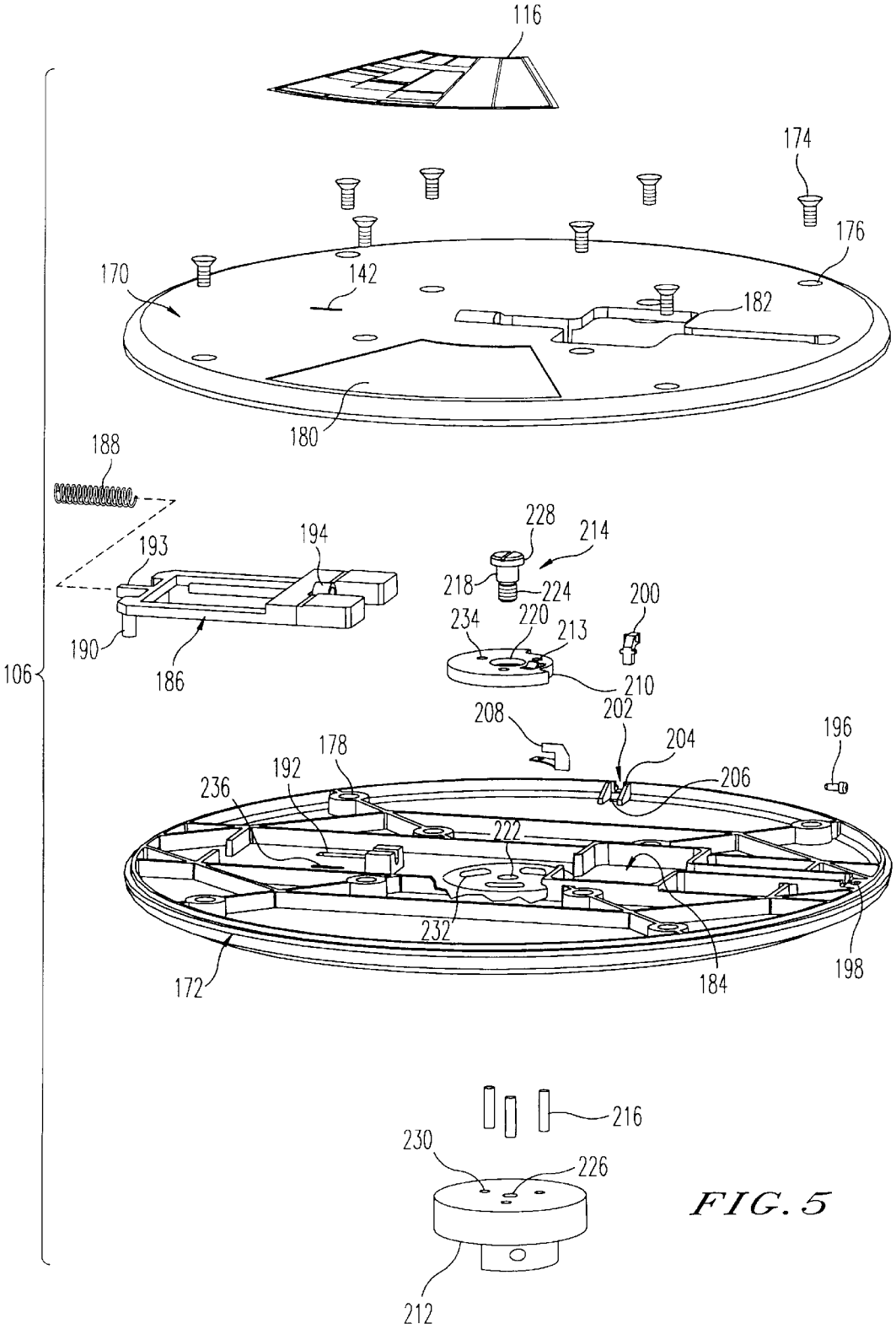
FIG. 5 is a detailed exploded perspective view of the rotor assembly of the centrifuge device shown in FIGS. 1 and 2.

The rotor assembly 106 will now be described in more detail with respect to FIG. 5. As shown in FIG. 5, the rotor assembly includes a rotor top 170 and a rotor bottom 172 that are coupled together by screws 174 which pass through corresponding openings 176 in the rotor top 170 and are received into corresponding screw receiving holes 178 in rotor bottom 172. The rotor top 170 and rotor bottom 172 can be made of any suitable material, such as metal, plastic, or preferably, a molded, composite material. Also, the rotor top 170 and rotor bottom 172 can alternately be snap-fit together, adhesive bonded, ultrasonically welded, or fit together by any other suitable fastener.

The calibration label 116 attaches to the label section 180 of rotor top 170. Also, rotor top 170 includes an opening 182 which, in cooperation with the cavity arrangement 184 in rotor bottom 172, forms the carrier tube accommodating recess 112.

The rotor assembly 106 further includes a carrier tube holder assembly 186 that is biased by a compression spring 188 as is described in more detail below. The carrier tube holder assembly 186 includes legs 190 which pass through corresponding slotted openings 192 in the rotor bottom 172, and a projection 193 which is described in more detail below. The carrier tube holder assembly 186 further includes a cup 194 which, as described in more detail below, receives an end of the carrier tube 114 when the carrier tube 114 is received in the carrier tube accommodating recess 112 of the rotor assembly 106.

The rotor assembly 106 further includes an engaging pin 196 which is mounted in pin receiving recess 198 in the rotor bottom 172 so that the front end of the pin 196 projects into the carrier tube accommodating recess 112 of the rotor assembly 106 and thus engages an end of the carrier tube 114 that is inserted in the carrier tube accommodating recess 112 as will be described in more detail below. The rotor assembly also includes a light pipe 200 that is inserted into light pipe receiving opening 202 in the rotor bottom 172. As described in more detail below, the light pipe 200 is configured so that light traveling in a direction radial to the rotor assembly 106 which enters the light pipe 200 through a light pipe side opening 204 is redirected by the light pipe 200 to exit the bottom of the rotor assembly 106 through light pipe bottom opening 206 in the rotor bottom 172.

The rotor assembly 106 further includes a pawl 208 that is secured to the rotor bottom 172 by, for example, heat staking or in any other suitable manner. The significance of pawl 208 is described in more detail below.

The rotor assembly 106 also includes an index hub assembly 210 that is coupled to a rotor hub assembly 212 by a screw 214 and limit pins 216. Specifically, a shaft portion 218 of the screw 214 passes through opening 220 in the index hub assembly 210, and through a central opening 222 in the rotor bottom 172, and a threaded portion 224 of the shaft portion 218 screws into opening 226 in motor hub 212. The diameter of the head 226 of the screw 214 is greater than the diameter of opening 218 in the index hub assembly 210 and thus, the screw 214 secures the index hub assembly 218, rotor bottom 172 and motor hub 212 together. Since the diameter of central opening 222 in the rotor bottom 172 is greater than the diameter of shaft portion 218 of the screw 214, the index hub 210 and motor hub 212 are rotatably coupled to the rotor bottom 172. The significance of this rotatable connection is described in more detail below.

Figure 6:
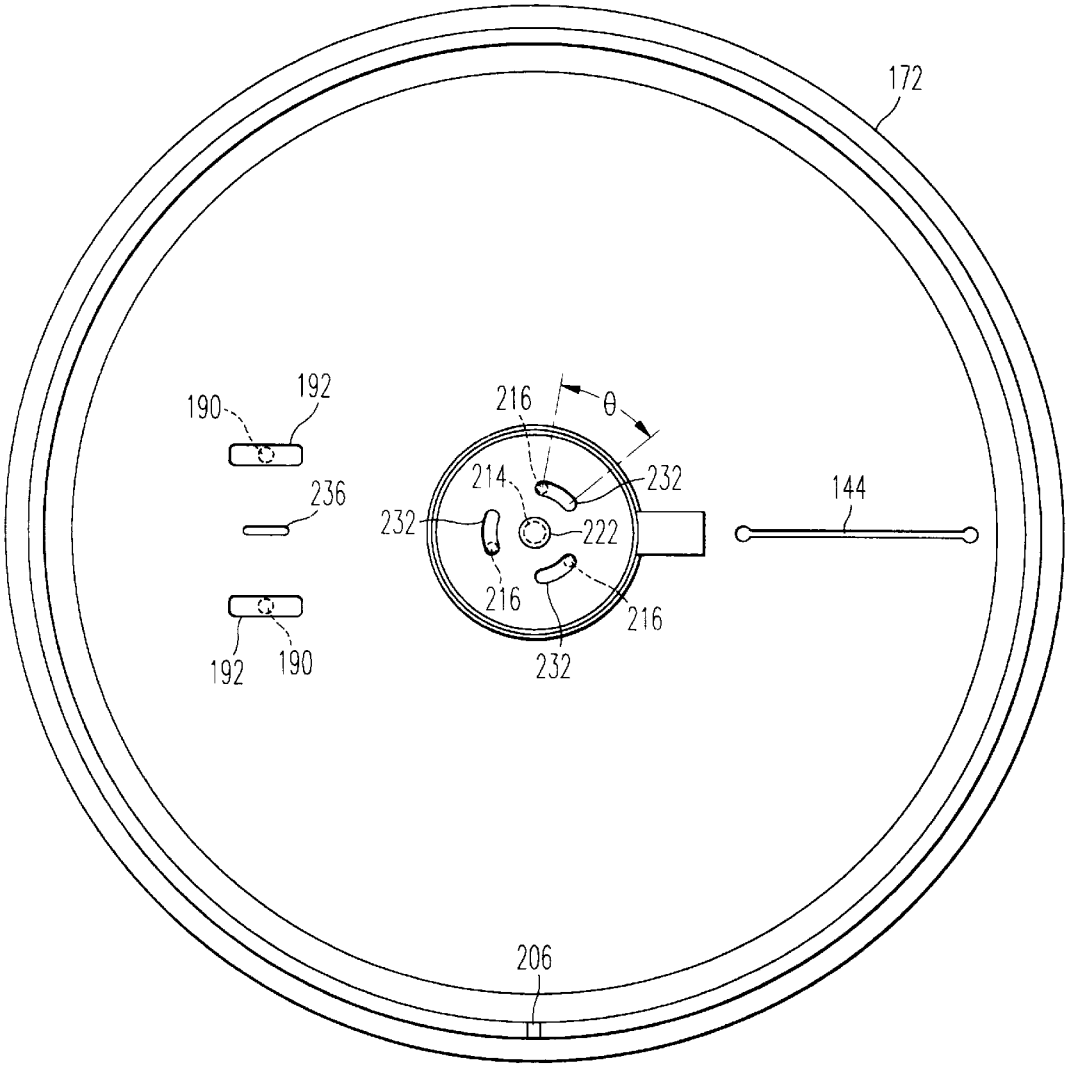
FIG. 6 is a bottom plan view of the rotor shown in FIG. 5.

As further illustrated, limit pins 216 are received and secured in respective openings 230 in the motor hub 212, and also pass through corresponding arcuate slots 232 in the rotor bottom 172 and are received and secured in corresponding openings 234 in the index hub assembly 210. As shown in FIG. 6, which is a plan bottom view of the rotor bottom 172 with the limit pins 216 and screw 214 shown in phantom, the arcuate slots 232 in the rotor bottom 172 limit the relative rotation of the index hub assembly 210 and motor hub assembly 212 with respect to the rotor bottom 172 to an angle θ. FIG. 6 also illustrates the slotted openings 192 with the legs 190 of the carrier tube holder assembly 186 shown in phantom, the light pipe bottom opening 206, the slit 144 (see FIG. 2), and a slit 236 which substantially aligns with slit 142 in the rotor top 170.

Figure 7:
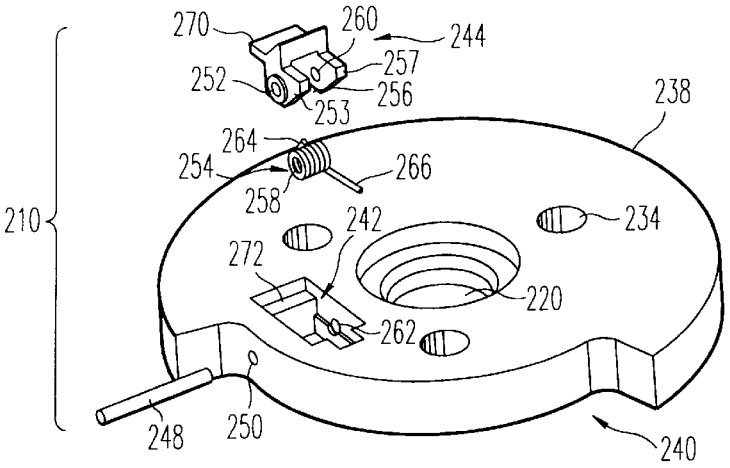
FIG. 7 is a detailed perspective view of the hub of the rotor assembly shown in FIG. 5.
Figure 8:
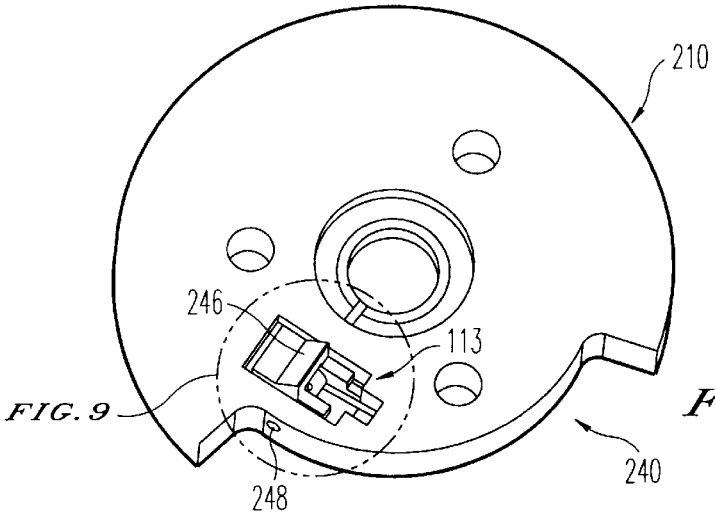
FIG. 8 is a detailed assembled perspective view of the hub shown in FIG. 6.
Figure 9:
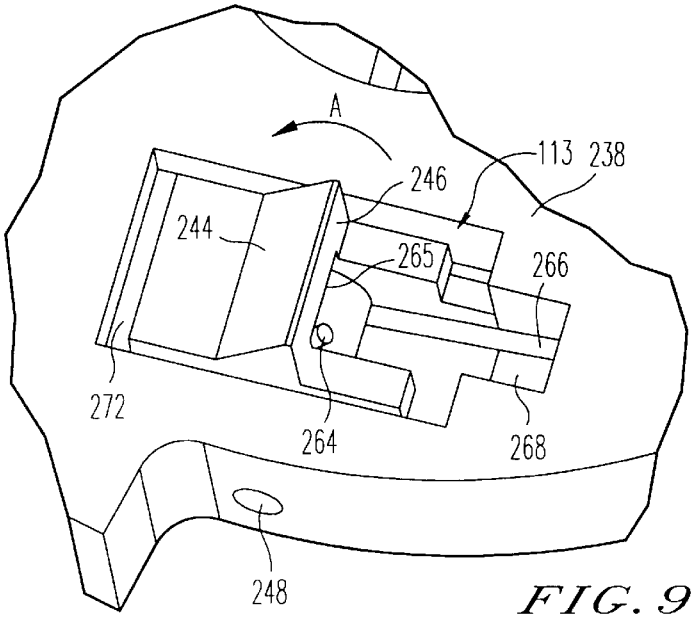
FIG. 9 is a detailed view of the indexing mechanism of the hub shown in FIGS. 7 and 8.

The index hub assembly 210 is shown in more detail in FIGS. 7–9. The index hub assembly 210 includes an index hub 238 in which holes 220 and 234 are formed. The index hub 238 further includes a cut-out portion 240 which, as described in more detail below, provides clearance for pawl 208 so that the index hub assembly 210 can rotate with respect to the rotor bottom 172 without being obstructed by the pawl 208. The index hub assembly 210 further includes a ratchet opening 242 which receives a ratchet 244 having a ratchet tooth 246 whose purpose is described in more detail below.

A pin 248 is inserted through opening 250 in the index hub 238 when the ratchet 244 is placed in the ratchet opening 242 as shown in FIGS. 8 and 9. The pin 248 passes out of opening 250 into the ratchet opening 242, and through opening 252 in one of the legs 253 of ratchet 244. A spring 254 is positioned in the space 256 between legs 253 and 257 of the ratchet 244, so that as the pin 248 passes through opening 252 in the leg 253, the pin enters opening 258 in spring 254. The pin 248 then passes through opening 258 in spring 254 and into opening 260 in leg 257 of ratchet 244. The pin 248 passes through opening 260 and is secured into opening 262 in the index hub 238.

Accordingly, as shown in FIGS. 8 and 9, the ratchet 244 is pivotally coupled to index hub 238 by pin 248. Furthermore, the leg 264 of spring 254 contacts the bottom 265 of ratchet tooth 246, while leg 266 of spring 254 contacts a shelf portion 268 of the hub 238. Therefore, the spring 258 biases the ratchet 242 in a direction indicated by arrow A in FIG. 9. However, the projection 270 of ratchet 244 contacts the shelf portion 272 of index hub 238 and thus, limits the rotation of ratchet 244 in the direction indicated by arrow A. The ratchet 244 and spring 254 assembly essentially constitutes the indexing mechanism 113 shown, for example, in FIGS. 1 and 2.

As is described in more detail in the aforementioned copending U.S. patent application of Bradley S. Thomas et al., entitled "Blood Centrifuge Device with Movable Optical Reader", Ser. No. 09/033,368, the rotor assembly orientation sensor 135 emits a light signal toward the circumference of the rotor assembly 106. When the light pipe 200 is at a position such that the light being emitted by the rotor assembly orientation sensor 135 enters the light pipe 200 through light pipe side opening 202 and is redirected through the light pipe bottom opening 206, the light is detected by a sensor in the rotor assembly orientation sensor 135. The rotor assembly orientation sensor 135 provides a signal to the CPU 110, which interprets that signal as an indication that the rotor assembly 106 is oriented at a known distance from the orientation which would align the carrier tube 114 in the carrier tube accommodating recess 112 with the plane of the lens and CCD array 128 of the CCD array assembly. In using this detected orientation as a reference orientation, the CPU 110 can continuously monitor and ascertain the orientation of the rotor assembly 106. A digital delay is created by the CPU 110 between the time the CPU 110 receives the signal from the rotor assembly orientation sensor 135 and the time at which the CPU 110 controls the flash tube 126 and CCD array 128 to read the sample in the carrier tube 114 to correct for variations on the speed of rotation of the rotor assembly 106, and for mechanical tolerances.

Figure 10:
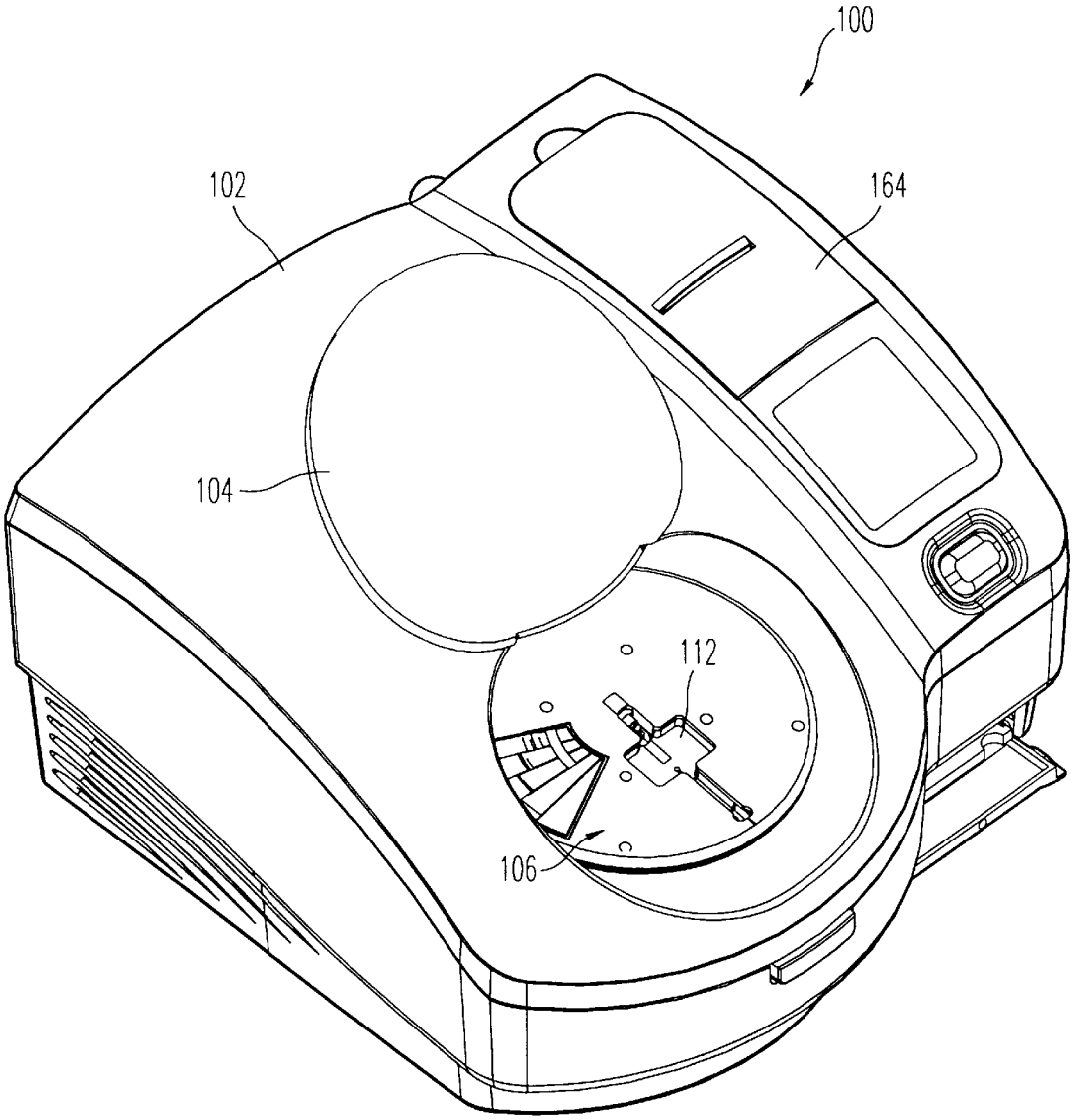
FIG. 10 is a perspective view of the centrifuge device shown in FIGS. 1 and 2, with the door in the open position and the rotor assembly being oriented for carrier tube loading.

When a carrier tube 114 is ready for loading into the centrifuge device 100, the microcontroller 110 will control the motor 108 to rotate the rotor assembly 106 to the proper orientation for loading of the carrier tube 114 as shown in FIG. 10, as can be determined through the use of the rotor assembly orientation sensor 135 as described above. This carrier tube loading orientation is essentially 180° from the orientation of the rotor assembly 106 as shown in FIGS. 1 and 2.

Figure 11A:
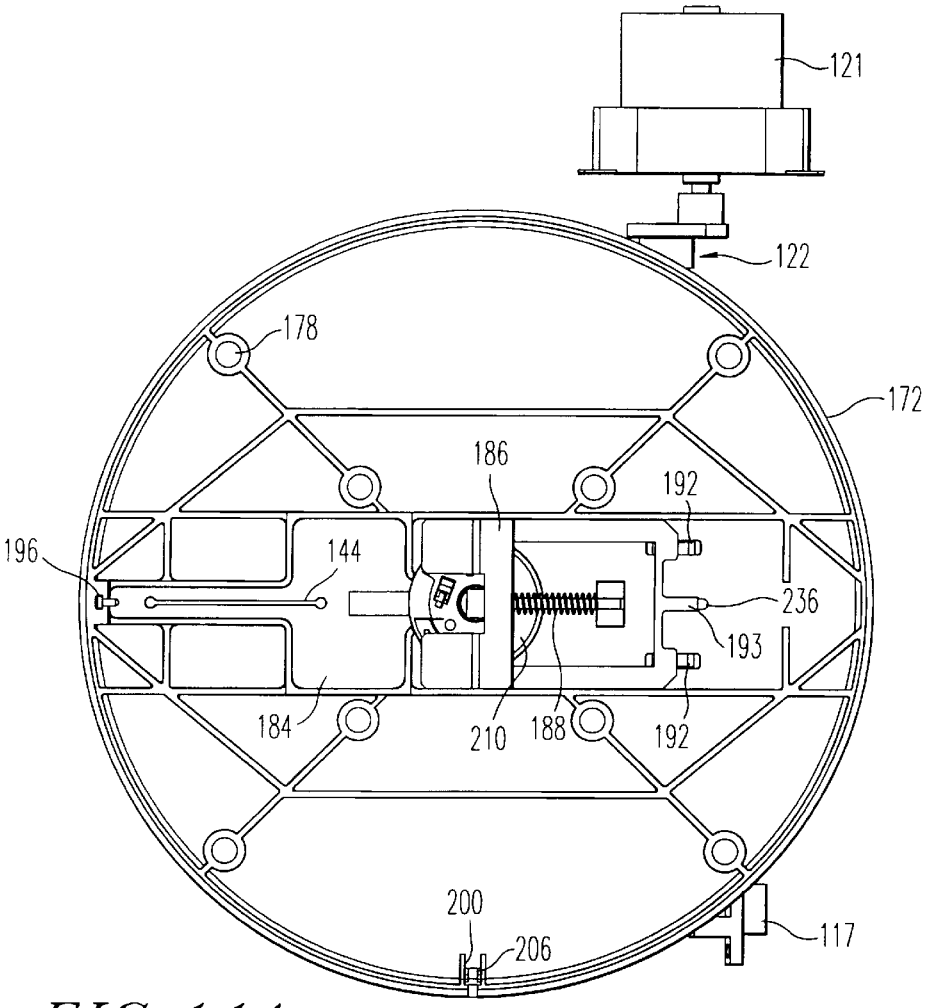
FIG. 11A is a top plan view of the rotor assembly shown in FIG. 5, with the top cover removed, in relation to the tube capture and release motor, and having the carrier tube holder assembly in the released position.
Figure 11B:
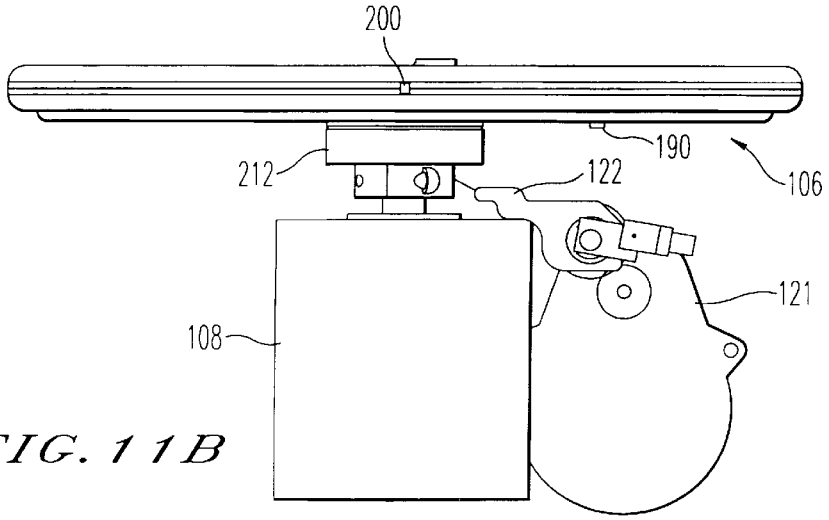
FIG. 11B is a side view of the rotor assembly shown in FIG. 5 with its cover attached, in relation to the tube capture and release motor and the engaging mechanism in the disengaged position.

FIG. 11A is a top plan view of the rotor assembly 106 as shown in FIG. 5, with the rotor top 170 being removed to expose the interior components of the rotor assembly 106, such as the carrier tube holder assembly 186, spring 188, pin 196, light pipe 200, and the index hub assembly 210. FIG. 11A also illustrates the tube capture and release motor 121 and the engaging mechanism 122. FIG. 11B is a side plan view further illustrating the relationship between the tube capture and release motor 121, the engaging mechanism 122, the rotor assembly 106 with its top 170 attached, and the rotor motor 108.

Figure 12A:
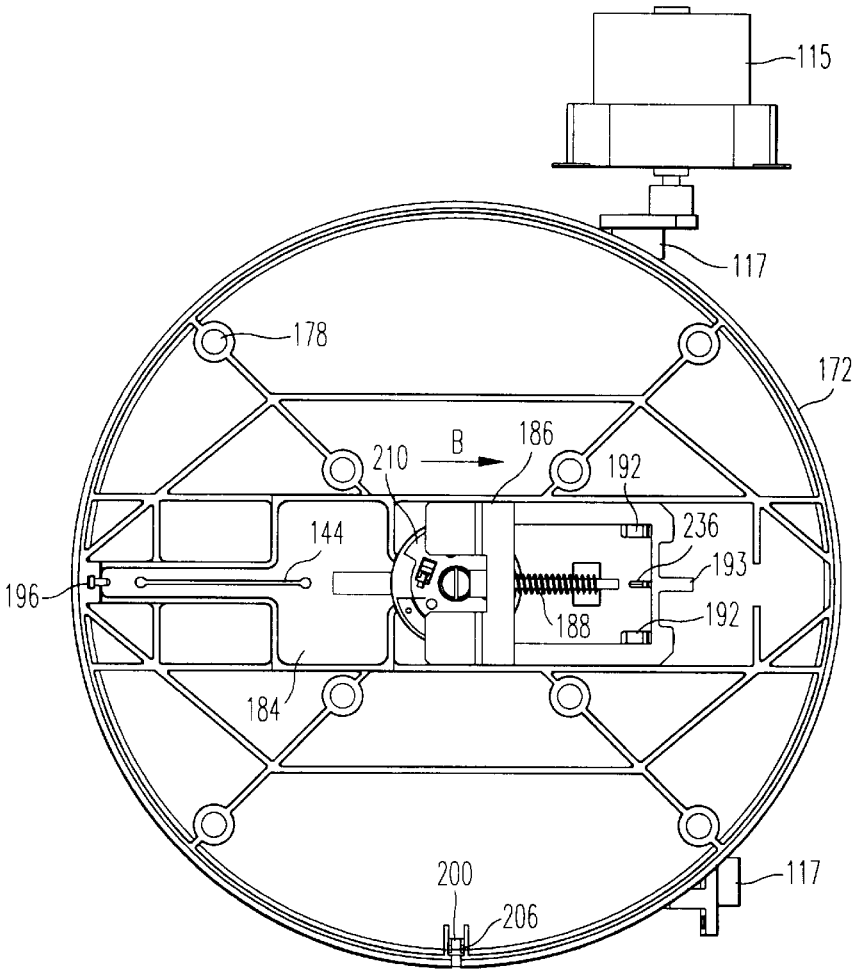
FIG. 12A is a top plan view of the rotor assembly and as shown in FIG. 11A, but with the tube holding assembly being positioned in the retracted position.
Figure 12B:
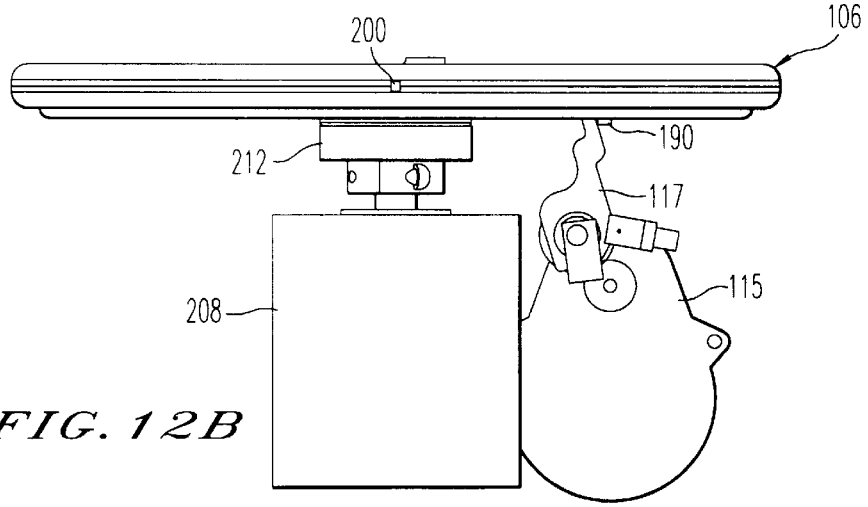
FIG. 12B is a side view of the rotor assembly, retractor assembly driving motor and the retractor assembly as shown in FIG. 11B, but with the retractor assembly driving motor engaging the retractor assembly.
Figure 13:
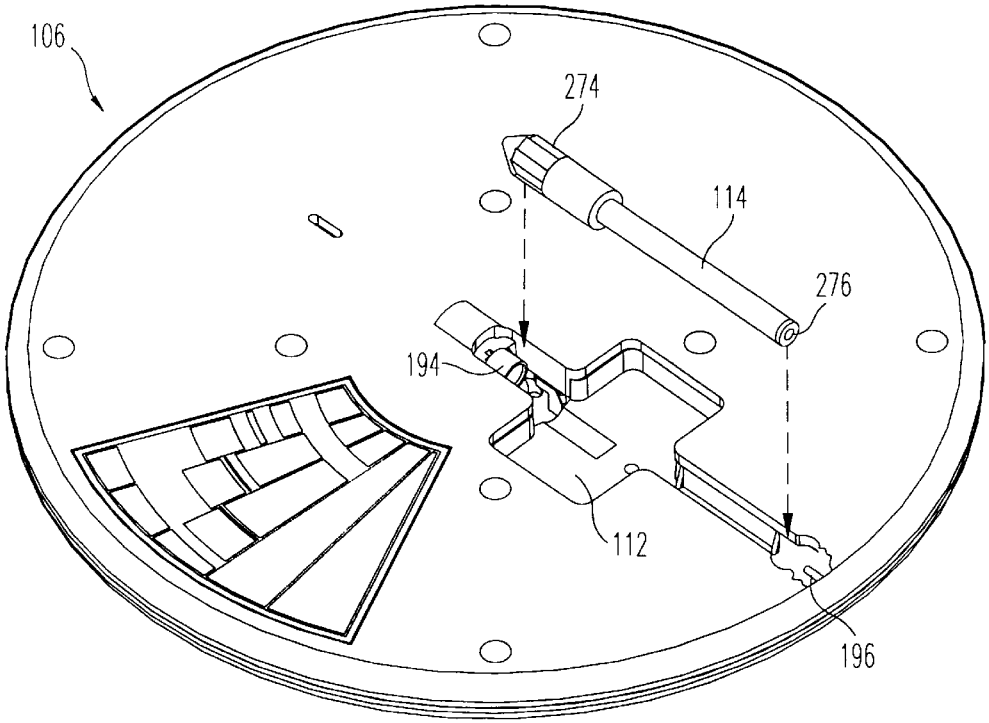
FIG. 13 is a detailed assembled perspective view of the rotor as shown in FIG. 5, with a carrier tube about to be inserted into the carrier tube accommodating recess.
Figure 14:
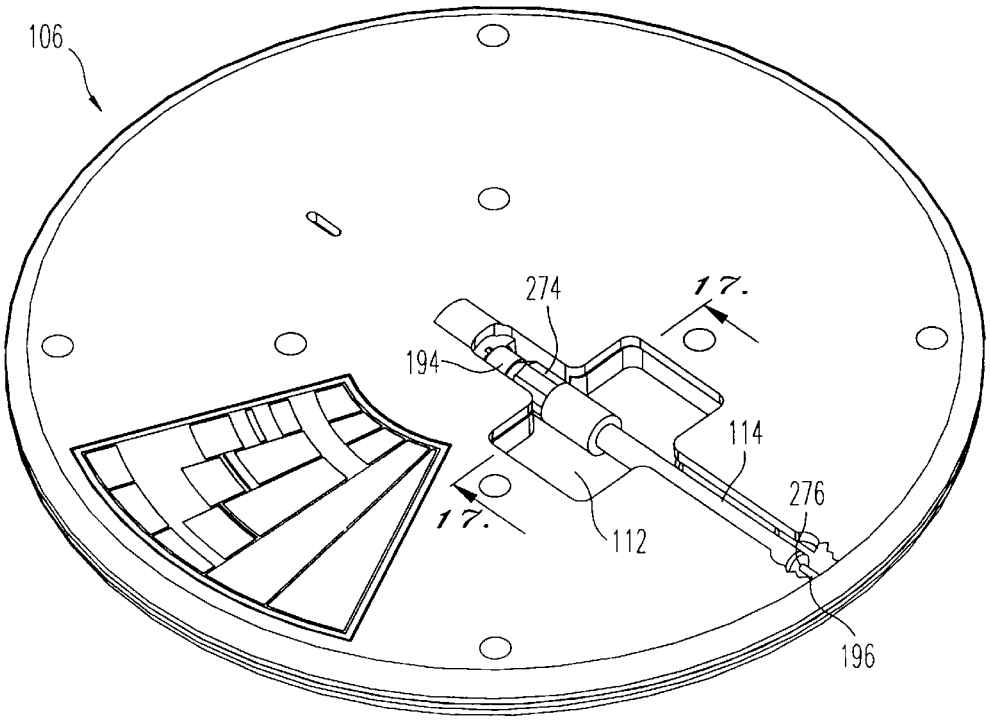
FIG. 14 is a detailed assembled perspective view of the rotor as shown in FIG. 5, with the carrier tube inserted in the carrier tube accommodating recess.

When the rotor assembly 106 has been oriented to the tube loading orientation, the CPU 110 will control the tube capture and release motor 121 to drive the engaging mechanism 122 to engage legs 190 of the carrier tube holder assembly 186. Hence, as shown in FIGS. 12A and 12B, the engaging mechanism 122 will pull the carrier tube holder assembly 186 in the direction indicated by arrow B in FIG. 12A against the force of spring 188. It is further noted that as long as the rotor assembly 106 is oriented so that the engaging mechanism 122 engages at least one leg 190 of the carrier tube holder assembly 186, the force exerted on that one leg 190 by the engaging mechanism 122 will be sufficient to rotate rotor assembly 106 as necessary to orient the rotor assembly 106 so that the engaging mechanism 122 will also engage the other leg 190. When the carrier tube holder assembly 186 is in the position indicated in FIG. 12A, the CPU 110 unlocks the door release and lock mechanism 116 to allow the door 104 to be opened so that the rotor assembly 106 can be accessed by an operator, and a carrier tube 114 can be loaded into the carrier tube accommodating recess 112 of the rotor assembly 106. As shown in FIGS. 13 and 14, the carrier tube 114 can then be loaded into the carrier tube accommodating recess 112 in the rotor assembly 106 such that the front portion of the geared cap 274 of the carrier tube 114 having gear teeth 275 is received into cup 194.

Once the carrier tube 114 has been loaded into the carrier tube accommodating recess 112, the operator closes the door 104 and presses start button 156 to instruct the CPU 110 to control the tube capture and release motor 121 to drive the engaging mechanism 122 back to the position shown in FIG. 11B. When this occurs, the force applied by the spring 188 to the carrier tube holder assembly 186 moves the carrier tube holder assembly 186 in the direction opposite to arrow B in FIG. 12A. The pin 196 in the rotor assembly 106 then engages an opening 276 at the bottom end of the carrier tube 114. Hence, the pin 196 and the cup 194 secure the carrier tube 114 in the carrier tube accommodating recess 112 at both ends of the carrier tube 114. The centrifuge device 100 is ready to perform the centrifugation on the sample in the capillary tube contained in the carrier tube 114.

Figure 15:
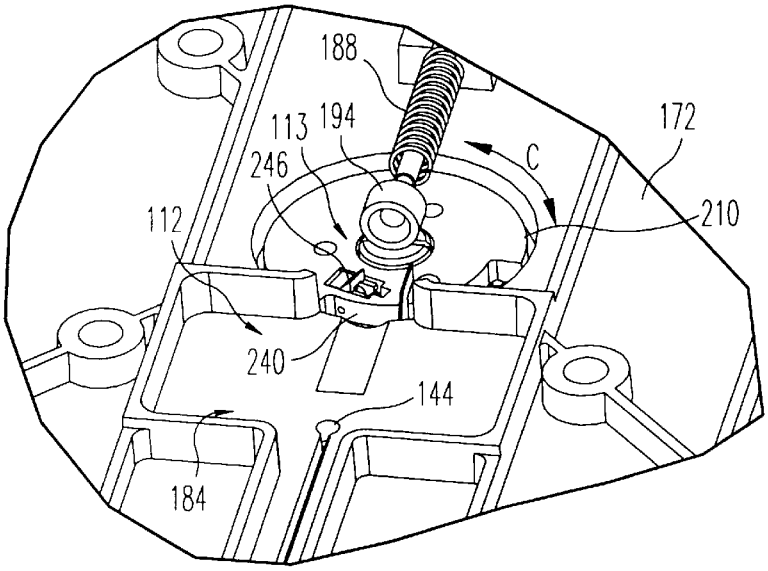
FIG. 15 is a detailed perspective view of the carrier tube accommodating recess, indexing mechanism and tube holding assembly of the rotor assembly as shown in FIG. 5.
Figure 16:
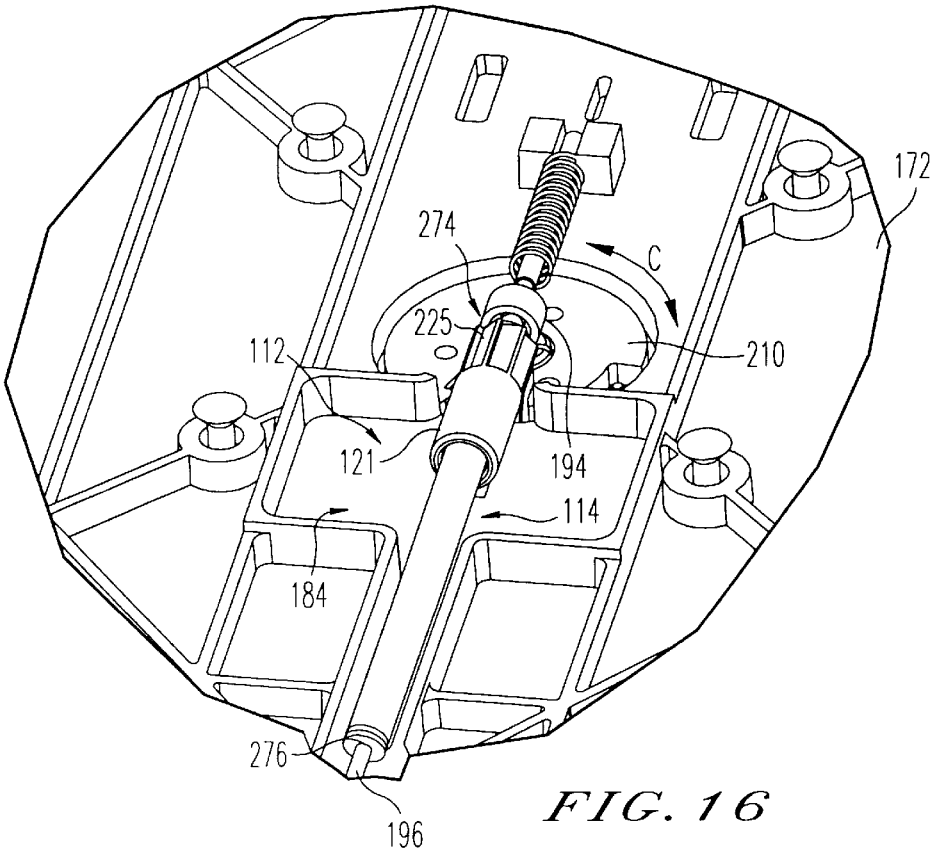
FIG. 16 is a detailed perspective view of the carrier tube accommodating recess and tube holding member of the rotor assembly as shown in FIG. 5, with a carrier tube being inserted in the carrier tube accommodating recess.
Figure 17:
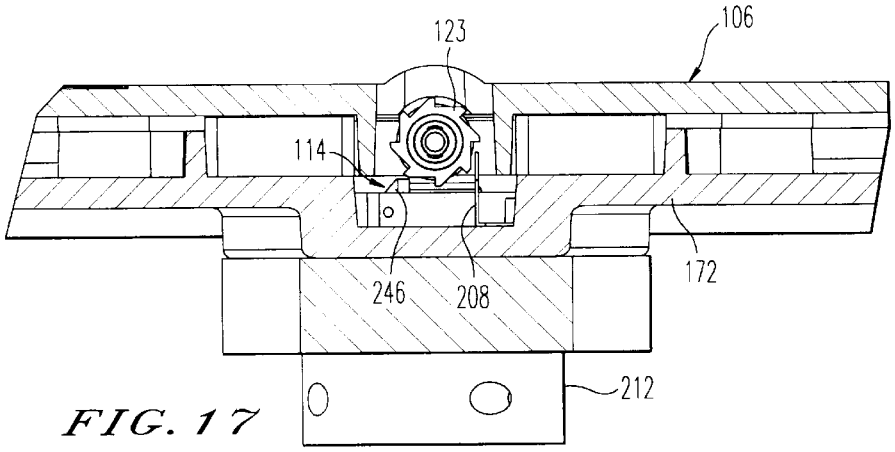
FIG. 17 is a detailed cross-sectional view of the rotor assembly having a carrier tube inserted in the carrier tube accommodating recess as taken along lines 17—17 in FIG. 14.

Placement of the carrier tube 114 in the carrier tube accommodating recess 112, and the relationship of indexing mechanism 113 and the geared cap 274 of the carrier tube 114 can be further appreciated from FIGS. 15 and 16. As shown in FIG. 15, the index hub assembly 210 is oriented such that the ratchet 246 is positioned as indicated. As discussed above, index hub assembly 210 can rotate with respect to the rotor bottom 172 in the direction indicated by arrow C as limited by the limit pins 216. The cut-out portion 240 of the index hub assembly 210 is positioned as indicated to provide clearance for the pawl 208 when the index hub 210 rotates. As shown in FIG. 16, when the carrier tube 114 is loaded into the carrier tube accommodating recess 112 and rests in the cavity 184 in the rotor bottom 172, the front end of the geared cap 274 of the carrier tube 114 is received in cup 194 and the pin 196 is received into the opening 270 at the opposite end of the carrier tube 114. FIG. 17, which is a cut away view of the rotor assembly 106 having the carrier tube 114 mounted therein as shown in FIGS. 14 and 16, illustrates the relationship between the ratchet tooth 246, the pawl 208 and the geared cap 274 of the carrier tube 114 more explicitly.

The indexing of the carrier tube 114 will now be described with respect to FIGS. 2–4, and FIGS. 18A–22B in particular. It is noted that the operations pertaining to the centrifugation of the sample in the capillary tube contained in carrier tube 114, as well as the reading of the centrifuged sample as performed by the centrifuge device 100, are described in more detail in the aforementioned U.S. patent application of Bradley S. Thomas et al. entitled "Blood Centrifuge Device with Movable Optical Reader", Ser. No. 09/033,368.

After the carrier tube 114 which holds the capillary tube containing the sample (e.g., uncoagulated blood) is loaded into the rotor assembly 106 in the manner described above, the centrifuge device 100 can begin to centrifuge the sample to separate the components of the sample into individual layers. The CPU 110 controls the motor rotor 208 to rotate the rotor assembly 106 at a suitable centrifuging speed, which is typically about 8,000 r.p.m. to about 12,000 r.p.m. After the sample has been centrifuged for the appropriate amount of time, which is typically about 3 to 5 minutes, the centrifuged sample in the capillary tube can be read by the optics in the optical carriage assembly 124 described above. The CPU 110 will typically decrease the rotation speed of the rotor assembly 106 to a suitable speed for reading, which is usually about 1,000–2,500 r.p.m. However, the centrifuging speed and the reading speed can be any practical speed.

As explained in more detail in the aforementioned U.S. copending application of Bradley S. Thomas et al. entitled "Blood Centrifuge Device with Movable Optical Reader", Ser. No. 09/033,368 when the carrier tube 114 has been loaded into the rotor assembly 106, the CPU 110 can control the drive board 111 to drive the LED bar 140 (see FIGS. 3 and 4) to emit light toward to bottom of the rotor assembly 106. As the slits 144 and 236 pass over the LED bar 140 when the rotor assembly 106 is rotating, the light emitted by the LED bar 140 will pass through those slits.

The CPU 110 can control the CCD array 128 (see FIGS. 2–4) to detect the presence of the light emitted by the LED bar 140 at the appropriate respective times when the slits 144 and 236 are directly over the LED bar 140. If the CCD array 128 detects light from the LED bar 140 as passing through an area of opening 144 where red blood cells in the sample in the carrier tube 114 normally would block light transmission when the opening 144 is over the LED bar 140, the CPU 110 will interpret this light detection as an indication that a carrier tube 114 is not present in the carrier tube accommodating recess 112. If, for example, the CPU 110 detects that the carrier tube 114 is no longer present in the carrier tube accommodating recess 112 while the rotor assembly 106 is being rotated, the CPU 110 can interpret this as an indication that the carrier tube 114 has become dislodged from the cup 194 and pin 196, and has possibly been ejected from the rotor assembly 106. In this event, the CPU 110 can, for example, control the LCD display 146 to display an error message, and control the rotor motor 108 to discontinue rotation of the rotor assembly 106.

On the other hand, if the CCD 128 detects light through the slit 142 in the rotor assembly 106 when the corresponding slit 236 in the rotor bottom 172 is above the LED bar 140, but does not detect light through slit 144 when the slit is above the LED bar 140, the CPU 110 could interpret this detection as an indication that the carrier tube holder assembly 186 has not properly engaged the carrier tube 114. That is, as can be appreciated from FIGS. 11A and 12A, when the carrier tube 114 has been loaded properly in the carrier tube accommodating recess 112 and is engaged properly with the tube holder assembly 186, the projection 193 will obstruct the opening 236, so that essentially no light will be allowed to pass through slit 142 in the rotor top 170 when corresponding slit 236 in the rotor bottom 172 passes over LED bar 140.

However, if the carrier tube 114 is not held properly by the carrier tube holder assembly 186, or the geared cap 274 has not been properly inserted onto the carrier tube, projection 193 of the tube holder assembly 186 will not completely obstruct slit 236. In this event, light will pass through slit 236 and through corresponding slit 142, and thus be detected by CCD array 128. That is, if the geared cap 274 has not been capped far enough onto the carrier tube 114, the light will be detected as passing through the slit 236 at the end closest to the carrier tube 114. On the other hand, if the geared cap 274 has been capped too far onto the carrier tube 114 (e.g., if the glass capillary tube in the carrier tube 114 has fractured), the light will be detected as passing through the slit 236 at the end furthest from the carrier tube 114. The CPU 110 will interpret either detection as indicating improper carrier tube loading, and thus, will take corrective action, such as displaying an error message on the LCD display 146 and stopping rotation of the rotor assembly 106.

Assuming that none of these problems have been detected, and therefore, the carrier tube 114 is properly loaded in the carrier tube accommodating recess 112, the reading of the sample in the capillary tube contained in the carrier tube 114 will be performed. After the appropriate number of readings have been taken of the sample by the CCD array 128 of the optical carriage assembly 124 when the carrier tube 114 is in its initial orientation in the rotor assembly 106, the CPU 110 will control the rotor assembly 106 to rotate the carrier tube 114 incrementally about its longitudinal axis so that readings of the sample can be taken from different locations about the circumference of the carrier tube 114.

That is, as described above in the background section of the application, it is desirable to take sample readings at different locations about the circumference of the carrier tube 114 (i.e., with the carrier tube 114 at different orientations about its longitudinal axis), to obtain more accurate measurements of the lengths of the layers in the centrifuged blood sample. The CPU 110 will therefore control the indexing mechanism 113 to perform this incremental rotation or "indexing" of the carrier tube 114. The CPU 110 controls the indexing mechanism 113 to perform the indexing of the carrier tube 114 indexing by changing the speed of the rotor motor 208 for a brief period of time.

Figure 18A:
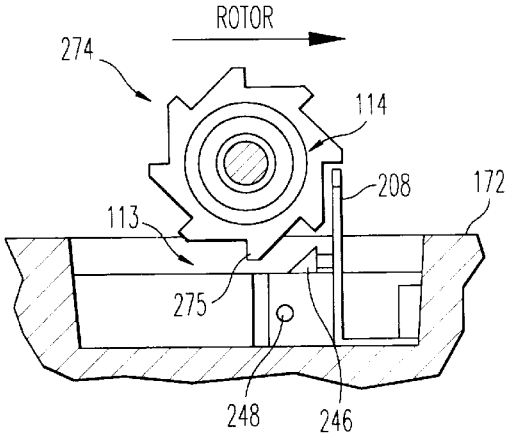
FIG. 18A is a detailed cross-sectional view showing the position of the indexing mechanism when the rotor assembly is being driven by the hub assembly.
Figure 18B:
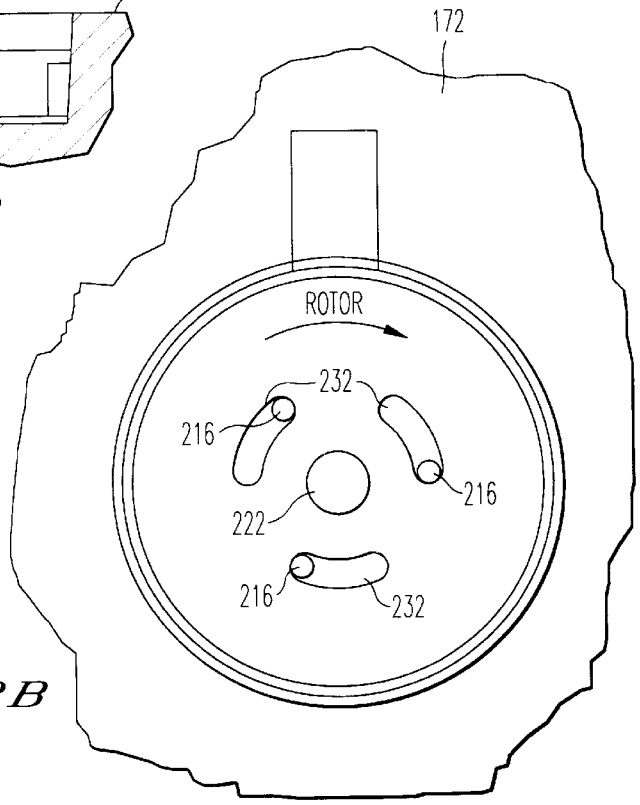
FIG. 18B is a detailed bottom view of the rotor assembly illustrating the positions of the limit pins of the index hub assembly relative to the rotor bottom when the indexing mechanism is positioned as shown in FIG. 18A.
Figure 19A:
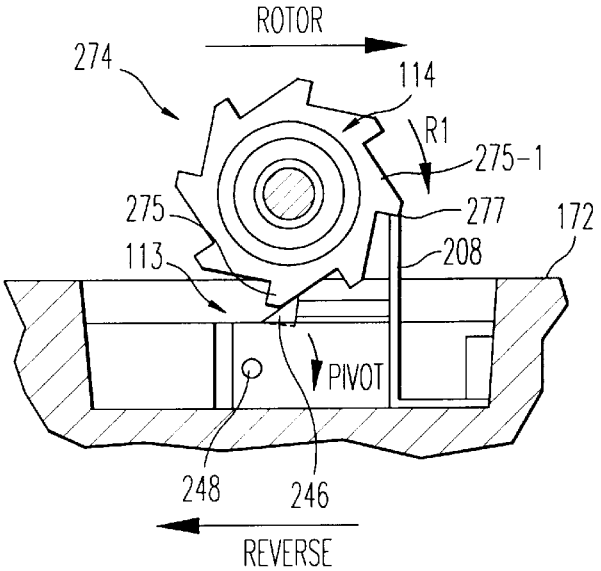
FIG. 19A is a cross-sectional view illustrating movement of the indexing mechanism with respect to the geared cap of the carrier tube when the hub assembly moves in a direction reverse to the rotor assembly.
Figure 19B:
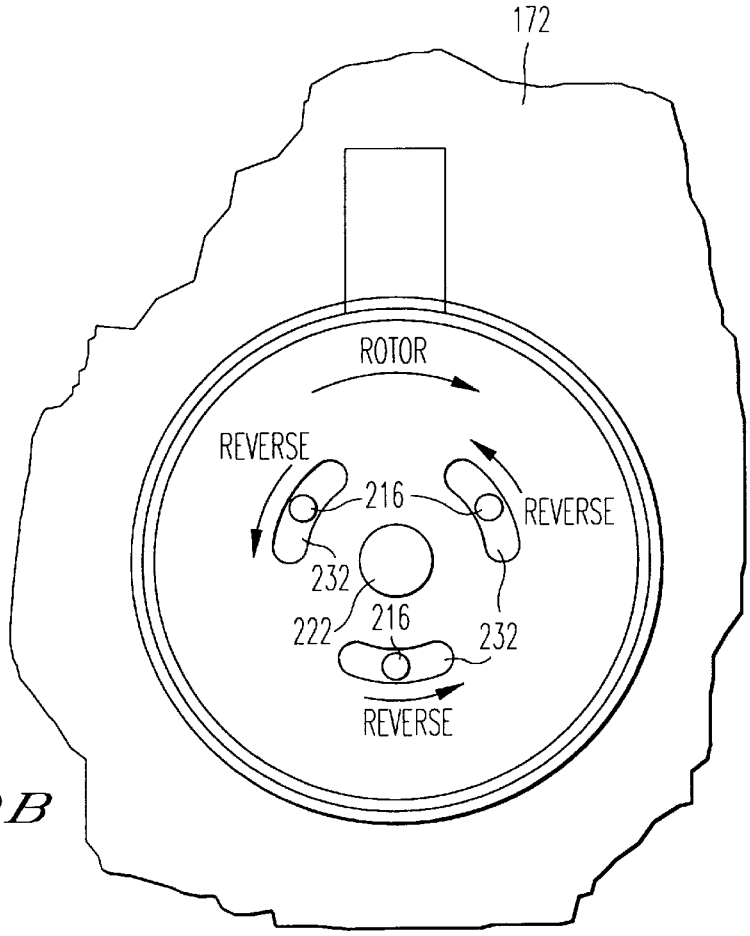
FIG. 19B is a detailed bottom view of the rotor assembly illustrating the positions of the limit pins of the index hub assembly relative to rotor bottom when the indexing mechanism is positioned as in FIG. 19A.

Specifically, during reading and centrifugation, the rotor motor 108 normally rotates the rotor hub assembly 212 in one direction (e.g., counterclockwise). Because the motor hub assembly 212 is coupled to the indexing hub assembly 210 as described above, the index hub assembly 210 rotates essentially in unison with the motor hub assembly 212. Since the index hub assembly 210 and rotor hub assembly 212 are rotatably coupled to the rotor bottom 172, the limit pins 216 will move along arcuate slots 232 in the rotor bottom 172 until they engage the edges of the rotor bottom 172 defining the arcuate slots and thus begin to rotate the rotor assembly 106. Accordingly, during rotation of the rotor assembly 106, the indexing mechanism 113 is positioned as shown in FIG. 18A, and the limit pins 216 are positioned in slits 232 as shown in FIG. 183. The rotor assembly 106 rotates in the direction indicated by the arrow labeled ROTOR in FIG. 18B.

When the indexing mechanism 113 is to perform the indexing operation, the CPU 110 will control the rotor motor 108 to abruptly decrease its rotation speed for a brief period of time (e.g., 0.25 seconds). When the rotation speed of the rotor motor 208 abruptly decreases during this time period, the rotation of the motor hub 212 abruptly slows down. Because the motor hub 212 is coupled to the index hub assembly 210 as described above, the rotation of the index hub assembly 210 also slows down abruptly.

However, because the rotor bottom 172 is rotatably coupled to the index hub assembly 210 and hub assembly 212 as described above, the rotor bottom 172 and hence, all of the rotor assembly 106 except for the index hub assembly 210 and motor hub assembly 212 will continue to rotate at substantially the same rotational speed prior to the slowing of the rotor motor 208 due to the rotational momentum of the rotor assembly 106. When this occurs, the rotor assembly 106 will continue to move relative to the index hub assembly 210 in the direction indicated by the arrow ROTOR in FIGS. 19A and 19B. The carrier tube 114, being mounted in the rotor labeled assembly 106, will also move in the direction of the arrow labeled ROTOR with respect to the index hub assembly 210.

Accordingly, this movement will cause the indexing mechanism 113 to move in the direction indicated by arrow labeled REVERSE relative to the rotor assembly 206 and the carrier tube 114 loaded therein. Therefore, the ratchet tooth 246 of the ratchet 244 of the index assembly 113 will come in contact with one of the gear teeth 275 of the geared cap 274 of the carrier tube 114. When this occurs, the force exerted on ratchet tooth 246 by the gear tooth 275 causes the ratchet 244 to pivot in the direction indicated by arrow labeled PIVOT about pin 248, and thus causes ratchet tooth 246 to move into recess 242 in the index hub assembly 210. Furthermore, due to the force exerted on gear tooth 275 by the ratchet tooth 246, the geared cap 274 and hence, the carrier tube 114 as a whole, will begin to rotate about the longitudinal axis of the carrier tube 114 (or an axis essentially aligned with that longitudinal axis) in a direction indicated by arrow R1. However, because the tooth 275-1 will abut against the top 277 of pawl 208, the pawl 208 will restrict the distance that the geared cap 274 and the carrier tube 114 as a whole can rotate in the direction of arrow R1.

As the indexing mechanism 113 continues to move in the direction indicated by arrow labeled REVERSE, the force exerted on ratchet tooth 246 by gear tooth 275 will be sufficient to overcome the force exerted on ratchet tooth 246 by spring 254 (see FIGS. 7–9) and therefore, ratchet tooth 246 will continue to pivot in the direction of arrow "PIVOT" about pin 248 further into recess 242 in the index hub assembly 210. The ratchet tooth 246 can therefore pass by gear tooth 275 as the indexing mechanism 113 continues to move in the direction indicated by arrow labeled REVERSE.

Figure 20A:
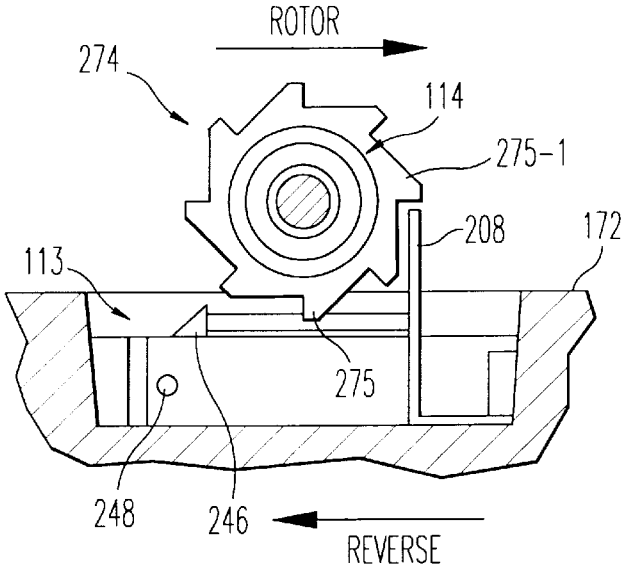
FIG. 20A is a detailed cross-sectional view illustrating the indexing mechanism when the hub assembly is in the farthest reverse position with respect to the rotor bottom.
Figure 20B:
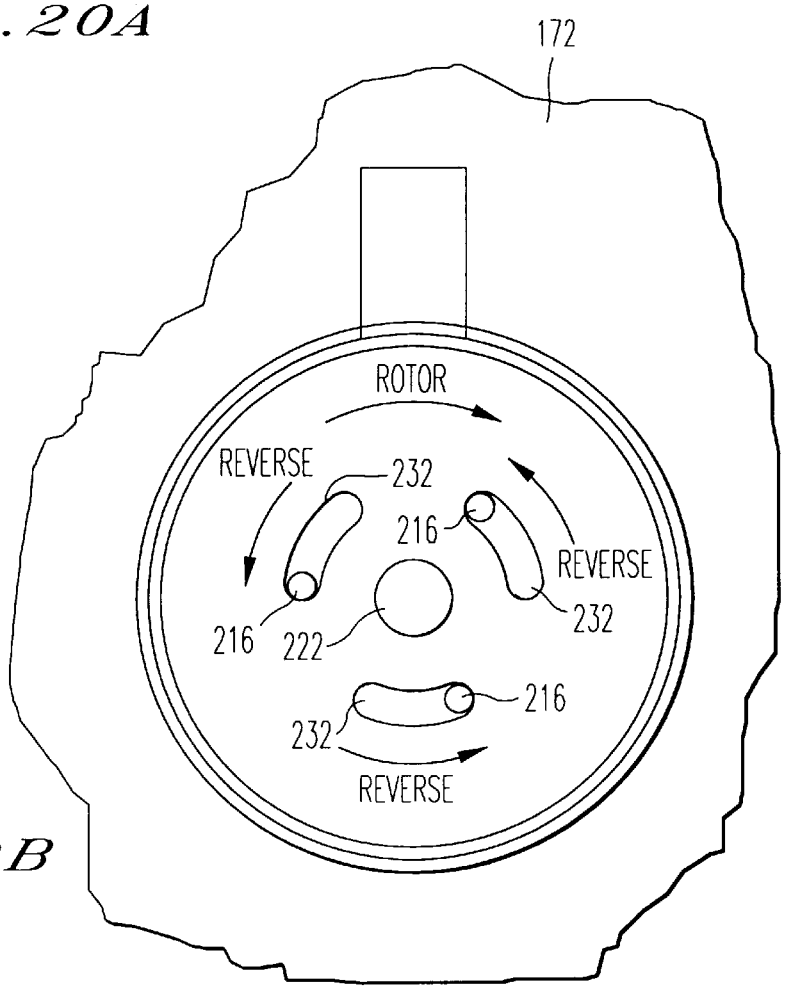
FIG. 20B is a detailed bottom view of the rotor assembly illustrating the positions of the limit pins of the index hub assembly relative to the rotor bottom when the indexing mechanism is positioned as in FIG. 20A.

As shown in FIGS. 20A and 20B, as the indexing mechanism 113 moves in the direction indicated by arrow labeled REVERSE, the limit pins 216 move in arcuate slots 232 until they reach a position in which they abut against the edges of rotor bottom 172 defining the elongated slots 232. Because the gear tooth 275 no longer contacts ratchet tooth 246, the force exerted by spring 254 (see FIGS. 7–9) causes the ratchet 244 to pivot about pin 248 back to its normal position as shown in FIG. 20A.

Figure 21A:
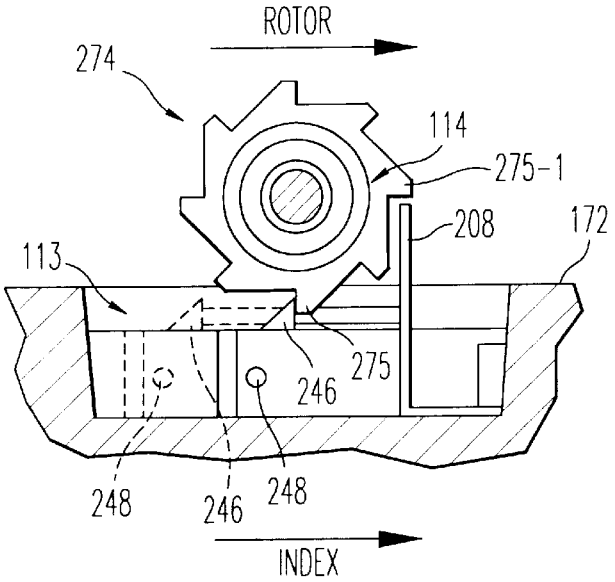
FIG. 21A is a detailed cross-sectional view showing the indexing mechanism beginning to engage a tube of the gear portion of the cap of the carrier tube inserted in the carrier tube accommodating recess of the rotor.
Figure 21B:
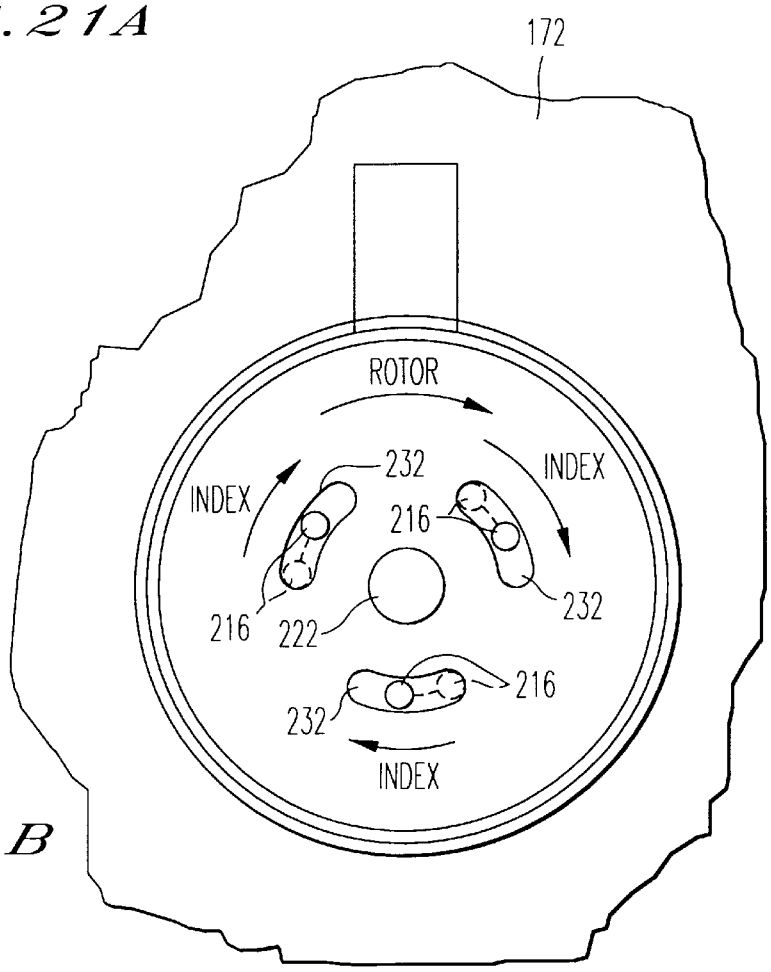
FIG. 21B is a detailed bottom view of the rotor assembly illustrating the positions of the limit pins of the index hub assembly relative to the rotor bottom when the indexing mechanism is positioned as in FIG. 20A.

After the predetermined period of time has elapsed that the speed of rotation of the rotor motor 208 has been abruptly decreased, the CPU 110 will abruptly increase speed of rotation of the rotor motor 208 back to its normal rotation speed at which reading of the carrier tube 114 is performed during non-indexing periods. When this occurs, as shown in FIG. 21A, the indexing mechanism 113 begins to move in the direction indicated by arrow labeled INDEX relative to the rotor bottom 172 and, hence, relative to the remainder of the rotor assembly 206. That is, since the motor hub 212 begins to be driven at the normal reading rotational speed by the rotor motor 208, the motor hub 212, the index hub assembly 210 and the indexing mechanism 113, will begin to catch up with the rotor bottom 172. As indicated in FIG. 21B, the limit pins 216 begin to move in the arcuate slots 232 in the rotor bottom 172 in the direction indicated by arrow labeled INDEX.

Figure 22A:
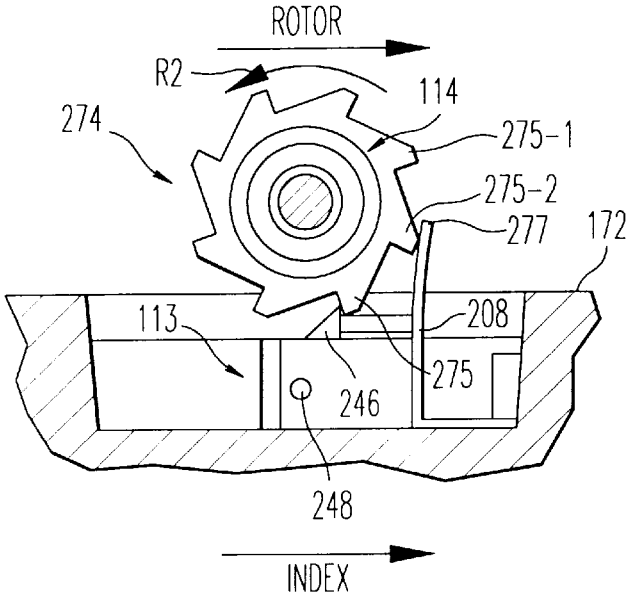
FIG. 22A is a detailed cross-sectional view illustrating rotation of the gear of the carrier tube cap due to engagement of a gear tooth by the indexing mechanism.
Figure 22B:
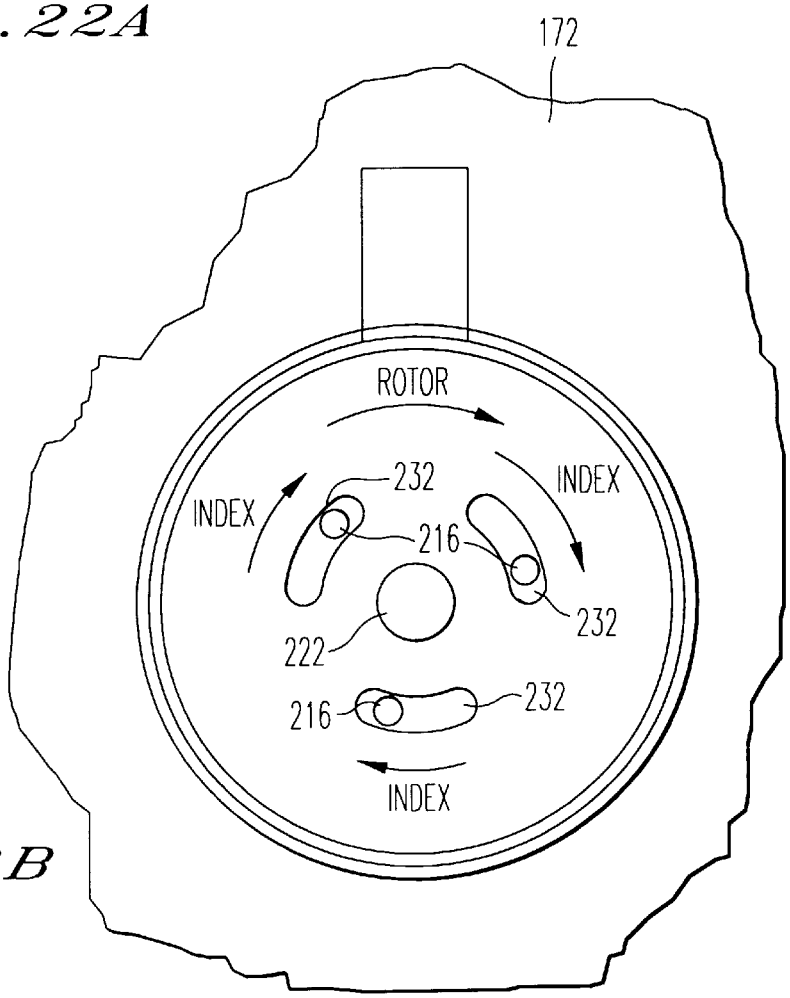
FIG. 22B is a detailed bottom view of the rotor assembly illustrating the positions of the limit pins of the index hub assembly relative to the rotor bottom when the indexing mechanism is positioned as in FIG. 21A.

As indicated in FIG. 22A, when the indexing mechanism 113 has moved further in the direction labeled INDEX, the ratchet tooth 246 causes the geared cap 274 of the carrier tube 114 and thus, the carrier tube 114 as a whole, to rotate about the longitudinal axis or about an axis substantially aligned with the longitudinal axis of the carrier tube 114 in a direction indicated by arrow R2. This movement causes the gear tooth 275-2 adjacent to pawl 208 to deform the pawl 208 slightly as indicated. As seen in FIG. 22B, the limit pins 216 have moved further along the arcuate slots 232 in the direction of arrow labeled INDEX relative to the rotor bottom 172 and hence, relative to the rotor assembly 106.

As shown in FIG. 6, the movement of the limit pins 216 is restricted by the length of arcuate slots 232 in the rotor bottom 172. Therefore, the angular distance that the index hub assembly 210 and hence, the indexing mechanism 113, can move with respect to the rotor bottom 172 is limited to the angle θ as set by the length of the arcuate slots 232. This relative angle θ of rotational movement is sufficient to enable the ratchet tooth 246 to rotate the geared cap 274 of the carrier tube 114 so that the gear tooth 275-2 which is adjacent to the gear tooth 275 of the geared cap 274 of the carrier tube 114 will pass just beyond the top 277 of the pawl 208. This distance rotational movement along arrow R2 by the geared cap 274 and carrier tube 114 as a whole is considered one index movement of the carrier tube 114, and essentially corresponds to the angular distance along the circumference of the geared cap 274 that is occupied by one gear tooth 275. That is, if the geared cap 274 has eight gear teeth, the distance of index movement is essentially 45°.

The entire indexing operation described with regard to FIGS. 18A–22B takes about 0.6 seconds. The indexing mechanism 113 has thus returned to the position as indicated in FIG. 18A, and the limit pins 216 abut against the edges of rotor bottom 172.

The rotor motor 208 then continues to drive the motor hub 212, which will continue to drive the rotor assembly 206 so that further readings of the centrifuged blood in the capillary tube held in the carrier tube 114 can be taken.

After the desired number of sample readings have been taken of the sample in the capillary tube contained in the carrier tube 114 with the carrier tube 114 being oriented in this newly indexed position, the carrier tube 114 can be indexed again by performing the steps described above with regard to FIGS. 18A–22B. After all of the readings have been taken from the desired amount of locations about the carrier tube 114, the CPU 110 can perform the appropriate calculations to arrive at the cell counts for each of the blood layers.

Although FIGS. 18A–22B illustrate the sequence of movement for indexing which occurs when the rotor assembly 106 is being rotated in a counterclockwise direction, the rotor motor 108 can instead control the rotor assembly 106 to rotate in a clockwise direction to centrifuge the sample in the carrier tube 114. In this event, the indexing mechanism 113 and the limit pins 216 are positioned with respect to the rotor bottom 172 as indicated in FIGS. 20A and 20B when the rotor assembly 106 is being rotated in the clockwise direction. The indexing is then performed in the sequence indicated by FIGS. 21A and 21B, 22A and 22B, 18A and 18B, 19A and 19B, and finishing back at FIGS. 20A and 20B. The operations that occur as described above with respect to each figure are similar for this type of indexing.

Figure 23:
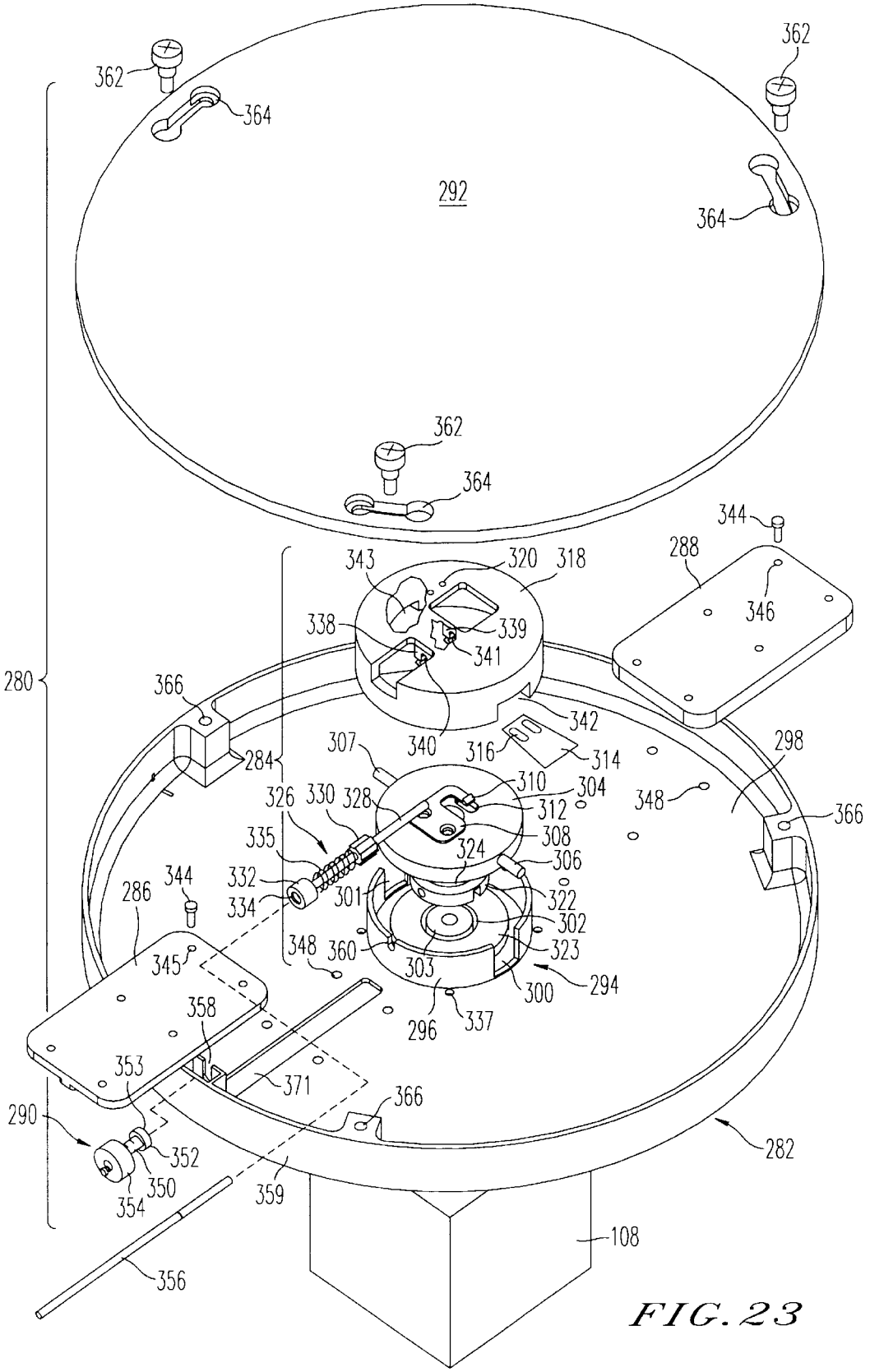
FIG. 23 is an exploded perspective view of a rotor assembly according to another embodiment of the present invention.

An alternate embodiment of the rotor assembly of the centrifuge device according to the present invention is shown in FIG. 23. Features of this alternate rotor assembly are described in the aforementioned copending U.S. patent application Ser. Nos. 08/814,535, now U.S. Pat. No. 5,888,184 and 08/814,536, now U.S. Pat. No. 5,889,685 both by Stephen C. Wardlaw.

Figure 24:
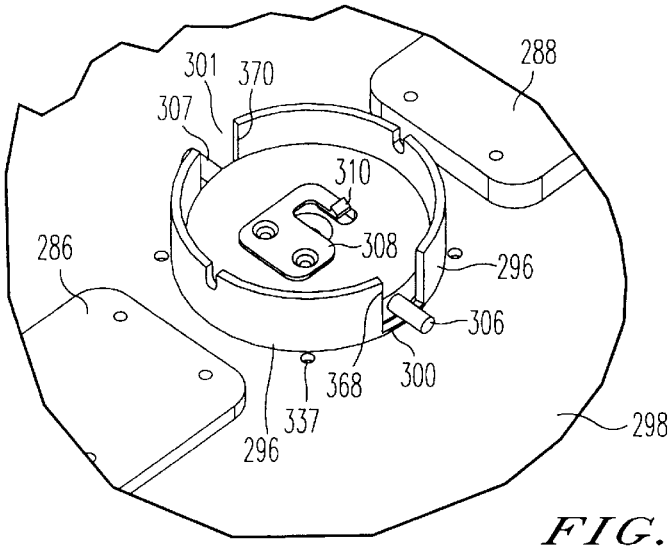
FIG. 24 is a detailed perspective view of the hub of the rotor assembly as shown in FIG. 23.
Figure 25:
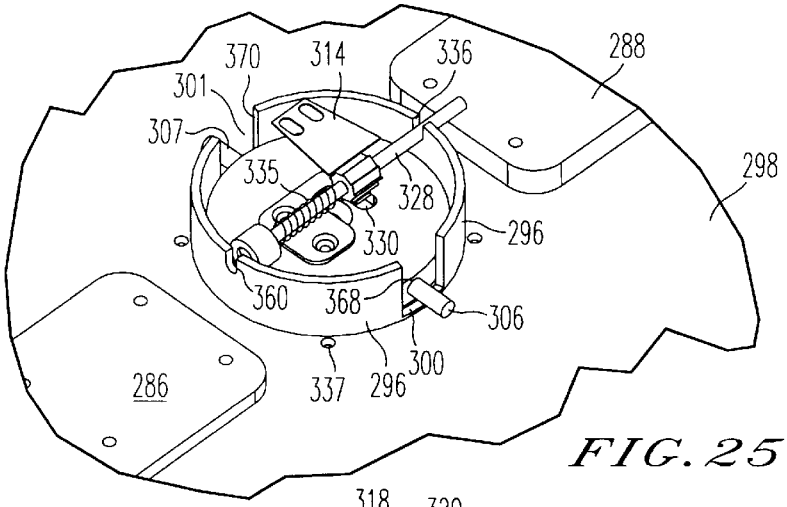
FIG. 25 is a detailed perspective view illustrating the relationship between the leaf spring, the shaft assembly, and the leaf spring of the hub assembly of the rotor assembly as shown in FIG. 23.
Figure 26:
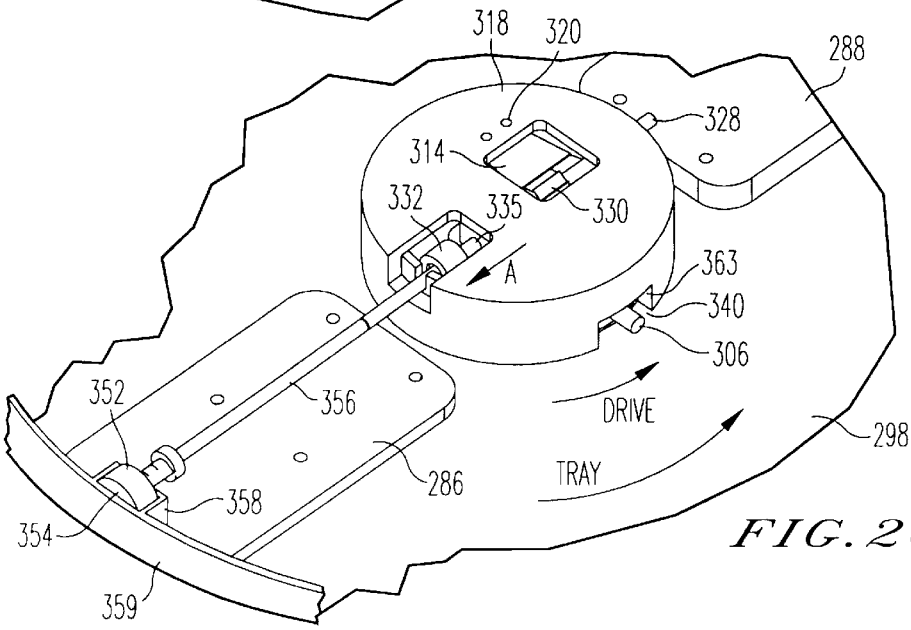
FIG. 26 illustrates a detailed assembled perspective view of the hub assembly of the rotor assembly as shown in FIG. 23.

As shown in FIG. 23, and in the more detailed views of FIGS. 24–26, the rotor assembly 280 includes a tray 282, a hub assembly 284, window 286, counterweight 288, a tube holding member 290 and a lid 292. The tray 282 can be made of any suitable material, such as metal, plastic, molded composite material or the like. The tray 282 includes a hub assembly engaging portion 294, which comprises two arcuately shaped members 296 and 297 which extend perpendicularly or substantially perpendicularly from the bottom 298 of the tray 282, and which are separated from each other by openings 300 and 301. The tray 282 further has an opening 302 which is in the center or substantially in the center of the bottom 298 of the tray 282, and through which passes the drive shaft 303 of the rotor motor 108 as described in more detail below.

As shown in FIG. 23 and in more detail in FIGS. 24–26, the hub assembly 284 includes a hub 304 having limit pins 306 and 307 which extend radially from the hub 304 at opposite locations on the hub 304. A leaf spring member 308, having a tooth 310 at an end thereof, is coupled to the hub 304 by any suitable coupling device, such as rivets, pins, screws or the like, such that the tooth 310 is positioned over an opening 312 in the hub 304. As shown in the aforementioned copending U.S. patent application Ser. Nos. 08/814,535, now U.S. Pat. No. 5,888,184 and 08/814,536, now U.S. Pat. No. 5,889,584 both by Stephen C. Wardlaw, instead of the leaf spring member 308, the hub 304 can be configured to accommodate a compression spring, and the tooth 310 can be positioned on top of the compression spring. The hub assembly 284 further includes a leaf spring 314 having slotted openings 316 therein, and a cover 318. In an assembled hub assembly 284, the openings 316 in the leaf spring 314 are aligned with openings 320 in the cover 318, so that the leaf spring 314 is coupled to the cover 318 by pins, screws, or any suitable fastening member which passes through a respective opening 316 and is held in a respective opening 320.

The hub assembly 284 further includes a spacer 322. When the hub assembly 284 is assembled to the tray 282, the drive shaft 303 of the rotor motor 108 passes through opening 302 in the tray, through an opening 324 in the spacer 322, and is coupled to the hub 304 by a screw, bolt, or the like. The spacer 322 is positioned between the hub 304 and a raised portion 323 of the bottom 298 of the tray 282, and the hub 304 is coupled to the spacer 322 and the shaft drive 303 so that the hub 304 and spacer 322 move in unison or substantially in unison with the drive shaft 303 of the rotor motor 108.

The hub assembly 284 further includes a gear shaft assembly 326, which includes a gear shaft 328 having a gear 330 mounted thereto, such that the axis of rotation of the gear 330 aligns with or essentially aligns with the axis of rotation of the gear shaft 328. A tube holding cup 332 is coupled to or integral with the gear shaft 328, and has an opening 334 therein. The axial center of the opening 334 aligns with or essentially aligns with the axis of rotation of the gear shaft 328. A compression spring 335 is mounted over the gear shaft 328 between tube holding cup 332 and gear 330 as shown.

When the hub assembly 284 is assembled, the gear shaft 328 is received into an opening 336 in arcuate extending member 297 of the tray 282 as shown in FIG. 25. The gear shaft 328 is positioned so that the gear 330 is engageable by the tooth 310 on the leaf spring 308. The cover 318 of the hub assembly 284 is coupled to the tray 282 by screws, rivets, pins or any suitable fastening member which pass through openings 337 in the tray 282 and engage the cover 318 to secure the cover to the tray 282. As shown in FIG. 23, the cover 318 includes projection members 338 and 339 which project downward from the inner top surface of the cover 318, and have arcuate notches 340 and 341, respectively, therein. The gear shaft 328 is received into these arcuate notches 340 and 341 such that the spring 335 on the gear shaft 328 is disposed between the back end of the tube holding cup 332 and the projecting member 338 as shown in FIG. 26, and the gear 330 is positioned to be on the side of the projecting member 339 opposite to the side facing projecting member 338. Hence, the spring 335 applies a force against the tube holding cup 332 to urge the gear shaft assembly 326 in the direction along arrow A in FIG. 26, and in doing so, the gear 330 abuts against the projecting member 339 to limit movement of the gear shaft assembly 326 along the direction indicated by the arrow A.

When the cover 318 is attached to the bottom 298 of the tray 282, the limit pins 306 and 307 pass through openings 342 and 343, respectively, on opposite sides of the cover 318. It is noted that the drive shaft 303 of the rotor motor 108 which is coupled to the hub 304 remains rotatable with respect to the tray 282. Therefore, hub 304, and pins 306 and leaf spring 308 which are coupled thereto, remain rotatable in relation to the tray 282. Accordingly, the hub 304 (and limit pins 306 and leaf spring 308) are rotatable with respect to the tray 282, the gear shaft assembly 326 that is coupled to the tray 282 as shown, and cover 318 to which leaf spring 314 is attached.

As further illustrated, the window 286 and counter weight 288 are mounted to the tray 282 by screws 344 that pass through respective openings 345 and 346 in the window 286 and counter weight 288, respectively, and engage with corresponding openings 348 in the tray 282. The tube holding assembly 290 includes a shaft 350, a tube holding cup 352 having an opening 353 therein, and a wheel 354. In this example, the tube holding cups 352 and 334 are configured to hold a capillary tube 356 that is not contained in a carrier tube. However, the size of the tube holding cups 352 and 334 can be configured to accommodate a carrier tube assembly in which a capillary tube 356 is held, such as carrier tube 114 described above, and as further described in the aforementioned copending U.S. patent application of Michael A. Kelly et al. entitled "Disposable Blood Tube Holder and Method for Using the Same" Ser. No. 09/033,733.

The shaft 350 of the tube holding assembly 290 mounts into slot 357 in a projecting portion 358 of the tray 282, such that wheel 354 is positioned between the projecting portion 358 and the side wall 359 of the tray 282 and prevents the shaft 350 from slipping out longitudinally through opening 358. The shaft 350 can rotate essentially unrestricted within opening 358.

When the capillary tube 256, or any tube or carrier tube, is loaded into the tray 282, the operator exerts force against tube holding cup 334 in the direction against the force applied by spring 335, to move the gear shaft assembly 328 in a direction opposite to arrow A in FIG. 26. One end of the tube 256 is then placed into opening 334 in the tube holding cup 332. In doing so, the capillary tube 356 passes through slot 360 in arcuate extension 296. The tube 356 is positioned so that the opposite end can be received into opening 353 in the tube holder cup 352. The tube holder cup 332 is made of a resilient material, such as rubber, Delrin, or any other suitable flexible material which is resilient to exert a force against the outer walls of tube 356 to transfer torque from tube holder 332 to tube 356.

Once the force being applied by the user to cup 332 is released, the spring 335 urges the gear shaft assembly 326 in the direction of arrow A in FIG. 26, and the tube is held in the tube holding cups 332 and 352 by the cups themselves, as well as the retaining force exerted on the cup 332 (and hence the tube 356) by spring 335. In order to load the tube 356 in the tray 282, the cover 292 must be off of the tray 282. After the tube 356 has been loaded, the cover 292 can be coupled to the tray 282 by suitable fastening members, such as screws 362 whose shafts pass through slotted openings 364 and are received into threaded openings 366 in the tray 282 to removably secure the cover 292 to the tray 282. The cover 292 is made of a clear material, such as clear plastic, so that the tube 256 can be viewed through the cover 292.

When the sample tube 356 has been loaded into the tray 282 of the rotor assembly 280, the tray 282 can be driven to centrifuge the sample in the sample tube 356. That is, as described above with regard to rotor assembly 106, the tray 282 can be rotated at a suitable centrifugation speed (e.g., 8,000 rpm–12,000 rpm). As can be appreciated from FIG. 26, when the rotor motor 108 is rotated to drive the centrifuge in the direction indicated by arrow labeled TRAY, the rotor motor 108 rotates the drive shaft 303 that is coupled to the hub 304. This causes the hub 304 and thus, the limit pins 306 and 307 to move in the direction indicated by arrow labeled DRIVE in FIG. 26. However, since the hub 304 is movable with respect to the tray 282, the tray 282 does not move initially as the shaft 303 begins to move.

Rather, as shown in FIG. 26, when the shaft rotates the hub 304 in the direction indicated by arrow labeled DRIVE, the limit pins 306 and 307 will engage the arcuately shaped members 296 and 297, respectively, at the respective edges 368 and 370. This engagement of the pins 306 and 307 with the arcuately shaped members 296 and 297 begins to rotate the tray 282 in the direction indicated by arrow labeled TRAY. Accordingly, the sample in the tube 356 is centrifuged.

As described above, after the sample in the tube 356 has been centrifuged for the desired amount of time (e.g., 3–5 minutes), images of the cell layers in the sample tube 356 can be read. Typically, the rotor motor 108 will slow the movement of the tray 282 to a reading speed (e.g., 1,000–2,500 rpm) at which the readings by the optics in the optical carriage assembly 124 (see FIGS. 2–4) will be taken. It is noted that as disclosed in aforementioned U.S. Pat. Nos. 5,888,184 and 5,889,584 by Stephen C. Wardlaw, a rotor assembly can be used in a centrifuge device having an optical reading assembly which reads the tube 256 through an opening in the bottom of the tray 282. To do this, the window 286 must be made of a clear material, such as clear plastic, so that the optical assembly can view the tube 256 through the window 256 and an opening 371 in tray 282.

Once the desired amount of readings have been taken along the circumference of the tube 356 with the tube 356 in this orientation, the tube 356 can then be rotated about its longitudinal axis so that the readings can be taken from locations along the circumference of the tube 356 when the tube 356 is at this new orientation. As described with respect to FIGS. 27A–31B, this indexing process is similar to that described above with regard to FIGS. 18A–22B. Specifically, FIGS. 27A, 28A, 29A, 30A, and 31A illustrate the relationship between the gear 330, the tooth 312, and the leaf spring 314 when indexing occurs. FIGS. 27B, 28B, 29B, 30B, and 31B are top views illustrating the relationship between the limit pins 306 and 307 and the arcuately shaped members 296 and 297.

Figure 27A:
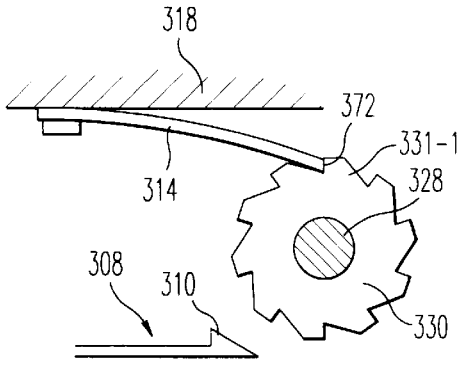
FIG. 27A is a detailed cross-sectional view illustrating the position of the tooth of the leaf spring attached to the hub of the tray assembly shown in FIG. 23 when the tray assembly is being driven by the hub.
Figure 27B:
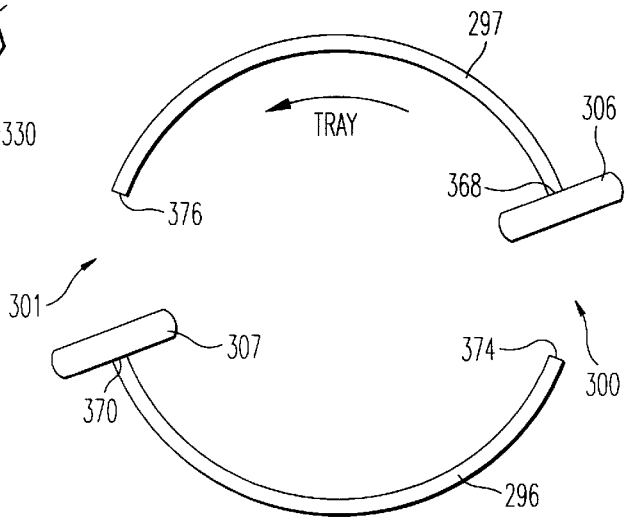
FIG. 27B is a diagrammatic view illustrating the relationship between the limit pins of the hub and the arcuately shaped members of the tray when the tooth of the leaf spring is positioned in relation to the gear as in FIG. 27A.
Figure 28A:
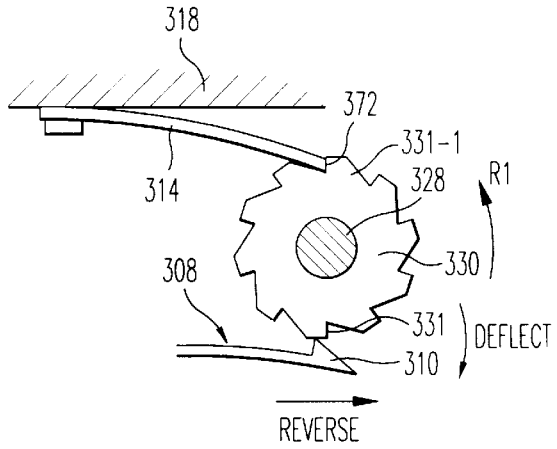
FIG. 28A is a detailed cross-sectional view illustrating the tooth of the leaf spring attached to the hub of the rotor assembly shown in FIG. 23 contacting the gear of the gear shaft assembly when the hub moves in a direction reverse to the tray assembly.
Figure 28B:
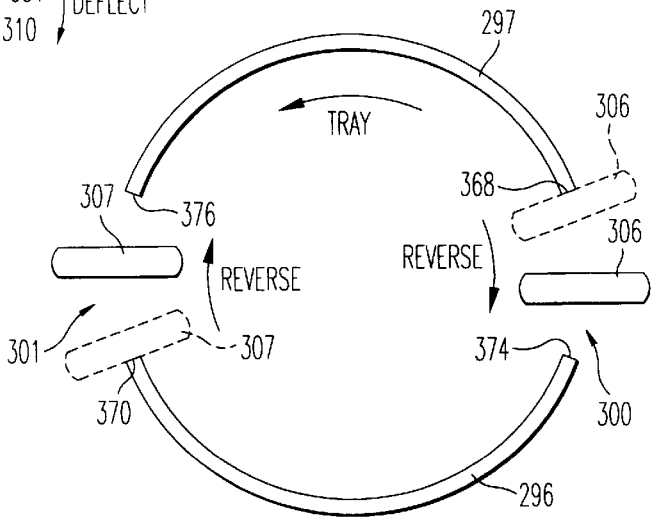
FIG. 28B is a diagrammatic view illustrating the relationship between the limit pins of the hub and the arcuately shaped members of the tray of the rotor assembly shown in FIG. 23 when the engaging member is positioned as in FIG. 28A.

When the hub 304 is driving the tray 282, the spring 308 is positioned relative to the gear 330 as shown in FIG. 27A, and the limit pins 306 and 307 are against edges 368 and 370 of arcuately shaped members 297 and 296, respectively, as shown in FIG. 27B. When indexing of the tube 356 is to be performed, the CPU 110 (FIGS. 3 and 4) will cause the rotor motor 108 to abruptly slow down for a period of time (e.g., 0.25 seconds). When this occurs, the rotation of the hub 304 will slow down, because the hub 304 is directly driven by the rotor motor 108. However, because the tray 282 is rotatable with respect to the hub 304, the momentum of the tray 282 will keep the tray moving in the direction indicated by arrow labeled TRAY in FIGS. 26 and 27B. Because the rotation of the hub 304 slows down, the limit pins 306 and 307 begin to move in the direction indicated by arrows labeled REVERSE in FIG. 28B relative to the tray 282. This movement of the hub 304 causes the tooth 310 of the spring 308 to contact a tooth 331 of the gear 330, as shown in FIG. 28A.

The continued movement of the spring 308 by the hub 304 in the direction indicated by arrow labeled REVERSE will cause the tooth 331 to continue to exert force on the spring 308, thus deflecting the spring 308 in the direction indicated by arrow labeled DEFLECT into the opening 312 in the hub 304 (see FIGS. 23–26). The force by the tooth 310 on the gear tooth 331 will also begin to urge the gear 330 to rotate in the direction indicated by arrow R1. However, the gear tooth 331-1 will be restricted from rotating by the end 372 of the spring 314 as shown. Hence, the gear 330 will be maintained in the indexed orientation shown in FIG. 28A.

Figure 29A:
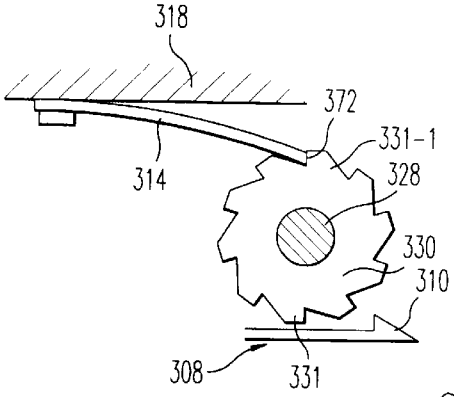
FIG. 29A is a detailed cross-sectional view illustrating the position of the tooth of the leaf spring attached to the hub of the rotor assembly shown in FIG. 23 when the hub is on the farthest reverse position with respect to the tray assembly.
Figure 29B:
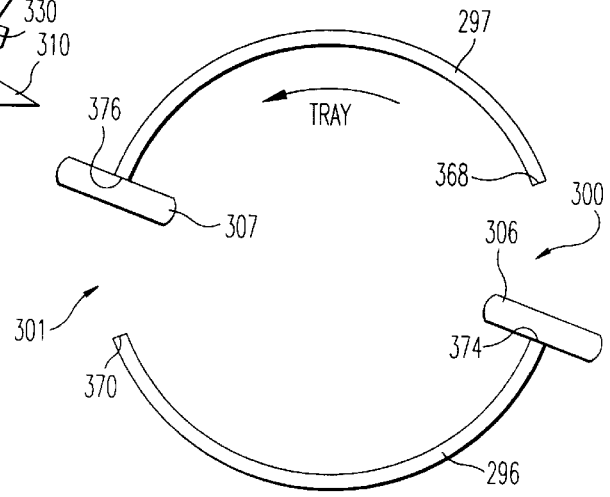
FIG. 29B is a diagrammatic view illustrating the relationship between the limit pins and the arcuately shaped members of the tray when the leaf spring is positioned as in FIG. 29A.

As shown in FIGS. 29A and 29B, as the rotation of the hub 304 slows with respect to the tray 282, the hub 304 rotates further in the direction REVERSE with respect to the tray 282. Hence, the pins 306 and 307 move further in the openings 300 and 301, respectively, until they contact edges 374 and 376 of arcuately shaped members 296 and 297, respectively.

Figure 30A:
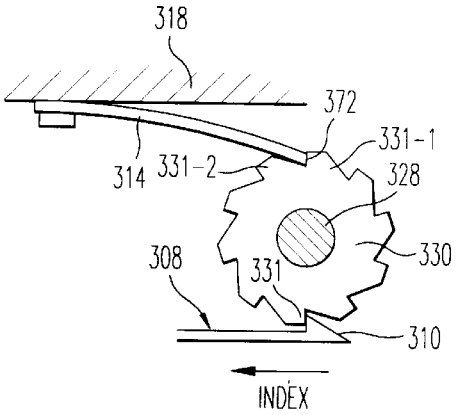
FIG. 30A is a detailed cross sectional view illustrating engagement of the tooth of the leaf spring attached to the hub of the rotor assembly shown in FIG. 23 with the gear of the gear shaft assembly.
Figure 30B:
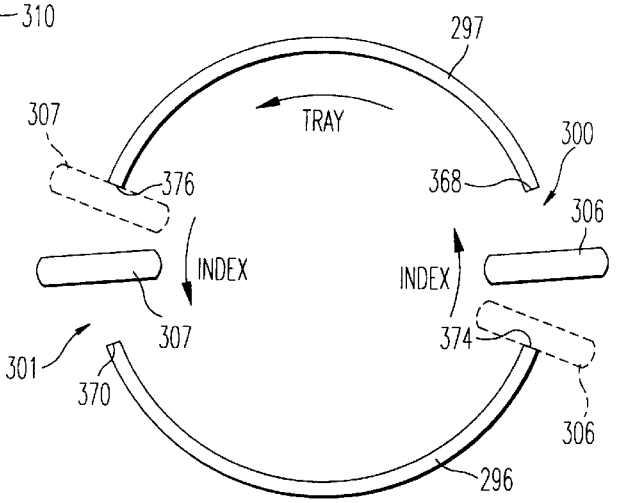
FIG. 30B is a diagrammatic view illustrating the relationship between the limit pins of the hub and the arcuately shaped members of the tray of the rotor assembly shown in FIG. 21 when the tooth of the leaf spacing is positioned in relation to the gear as in FIG. 30A.
Figure 31A:
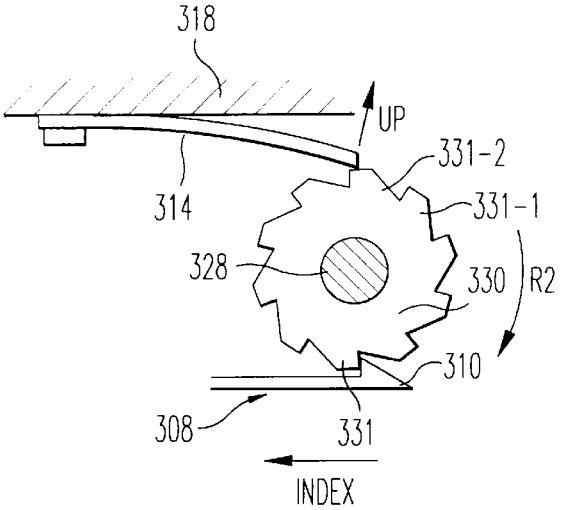
FIG. 31A is a detailed cross-sectional view illustrating rotation of the gear of the gear shaft assembly by the movement of the tooth of the leaf spring attached to the hub of the rotor assembly shown in FIG. 23.
Figure 31B:
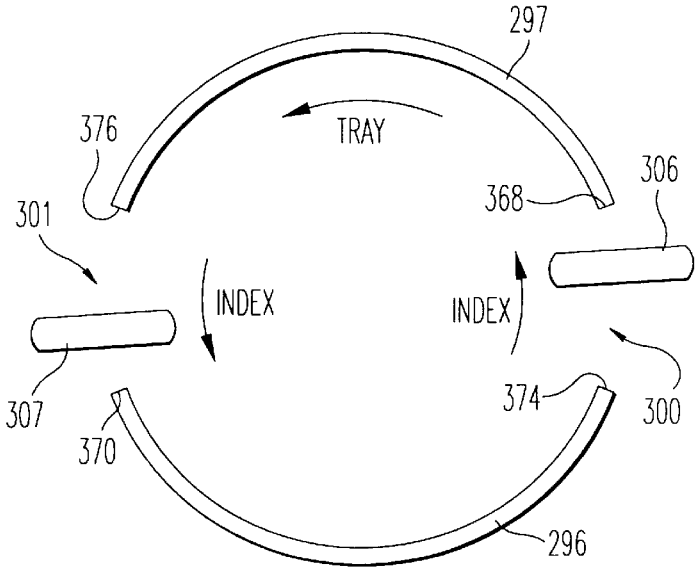
FIG. 31B is a diagrammatic view illustrating the relationship between the limit pins of the hub and the arcuately shaped members of the tray of the rotor assembly shown in FIG. 23 when the tooth of the leaf spring is positioned as in FIG. 31A.

The rotor motor 108 is then brought back up to the speed at which it was being rotated prior to beginning this indexing operation. When this occurs, the hub 304 begins to rotate in the direction INDEX as shown in FIGS. 30A an 30B. This movement of the hub 304 causes the tooth 310 to exert a force on the gear tooth 331, and thus rotate the gear 330 in the direction indicated by arrow R2 in FIG. 31A. It is noted that the spring 314 will be deformed by a gear tooth 331-2 in the direction along arrow UP. The gear shaft assembly 328 and thus, the tube 356 mounted in the tube holding cup 332, will rotate essentially in unison with the gear 330. Also, since the tube holding assembly 290 can rotate essentially unrestricted in slot 357, the tube holding assembly 240 will rotate essentially in unison with the tube 356.

The limit pins 306 and 307 eventually will contact edges 368 and 370 of arcuately shaped members 297 and 296, respectively, as shown in FIG. 27B. When this occurs, the hub 304 will have moved relative to the tray 282 such that the tooth 310 of the spring 308 has disengaged with the gear tooth 331 of the gear 330. The tooth 331-2 will then have rotated just past the edge 376 of the spring 314, and the gear shaft assembly 228, tube 356 and tube holding assembly 290 will have rotated accordingly.

Hence, the hub 304 will again begin to positively drive the tray 282 in the direction indicated by arrow labeled TRAY. The readings of the sample in the tube with the tube in this newly indexed orientation can then be taken. Once the desired amount of readings have been taken from this location of the circumference of the tube 356, the tube 356 can be indexed again in the manner described above by repeating the steps discussed with regard to FIGS. 27A–31B.

Although the sequence of operation shown in FIGS. 27A–31B illustrate the indexing steps performed when the tray assembly 282 is being rotated in the counterclockwise direction, indexing can also be performed if the tray assembly 282 is being rotated in a clockwise direction. In this event, the spring 308 and the limit pins 306 and 307 are positioned as shown in FIGS. 29A and 29B when the tray assembly 282 is being driven in the clockwise direction by the hub 304. The indexing then occurs in the sequence indicated by FIGS. 30A and 30B, 31A and 31B, 27A and 27B, 28A and 28B, and ending with the limit pins 306 and 307 and the spring 308 being positioned as shown in FIGS. 29A and 29B. The operations that occur as described above with respect to each figure are similar for this type of indexing.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

What is claimed is:

1. A method for centrifuging fluid contained in a fluid tube, comprising the steps of:

rotating a gear, which is mechanically coupled to the fluid tube, to rotate the fluid tube in a rotational direction transverse to the longitudinal axis of the fluid tube;

rotating the fluid tube about a rotational axis which is in substantial alignment with the longitudinal axis of the tube while the fluid tube is being rotated in the rotational direction;

placing the tube in a rotor; and wherein the transverse rotational direction rotating step comprises the step of rotating the rotor; wherein the rotor is movably coupled to a hub having an engaging member which is adaptable to engage the gear; and wherein the gear rotating step comprises the step of moving the hub relative to the rotor to drive the engaging member to engage and rotate the gear, by moving the hub relative to the rotor in a first direction substantially opposite to a direction of movement of the rotor, from a first position in relation to the rotor to a second position in relation to the rotor to apply the driving force to the engaging member to cause the engaging member to engage and rotate the gear.

2. A method as claimed in claim 1, further comprising the step of restricting rotation of the gear in a direction opposite to a direction in which the engaging member rotates the gear.

3. A method as claimed in claim 1, further comprising the step of placing the gear on the fluid tube.

4. A method as claimed in claim 1, wherein:

the engaging member is pivotally coupled to the hub; and the method further comprises the step of moving the hub in a second direction relative to the rotor and which is substantially opposite to the first direction, to place the engaging member in contact with the gear to cause the engaging member to pivot and move in a direction radial of the gear.

5. A method as claimed in claim 1, wherein:

the engaging member is a resilient member which is coupled to the hub; and the method further comprises the step of moving the hub in a second direction relative to the rotor and which is substantially opposite to the first direction, to place the engaging member in contact with the gear to cause the gear to deform the engaging member in a direction radial of the gear.

6. A method as claimed in claim 1, further comprising the step of limiting the movement of the hub relative to the rotor.

7. A method as claimed in claim 1, wherein:

the rotor comprises the gear; and the method further comprises the step of mechanically coupling the fluid tube to the gear.

8. A method as claimed in claim 1, wherein the rotational axis rotating step comprises the steps of rotating the gear in tooth increments corresponding to teeth on the gear, to rotate the fluid tube about the rotational axis in increments corresponding to the tooth increments.

* * * * *